US009679442B2

(12) United States Patent
Khal et al.

(10) Patent No.: US 9,679,442 B2
(45) Date of Patent: Jun. 13, 2017

(54) SYSTEM AND METHOD FOR PLAYING BINGO

(75) Inventors: Zak Khal, Las Vegas, NV (US); Moises Navarrete, Las Vegas, NV (US); Danny Patrick Daley, Reno, NV (US); Bruce Merati, San Diego, CA (US)

(73) Assignee: Gaming Arts, LLC, Las Vegas, NV (US)

( * ) Notice: Subject to any disclaimer, the term of this patent is extended or adjusted under 35 U.S.C. 154(b) by 256 days.

(21) Appl. No.: 12/946,401

(22) Filed: Nov. 15, 2010

(65) Prior Publication Data

US 2012/0122539 A1 May 17, 2012

(51) Int. Cl.

| | |
|---|---|
| ***G07F 17/32*** | (2006.01) |
| ***A63F 3/08*** | (2006.01) |
| ***A63F 3/06*** | (2006.01) |

(52) U.S. Cl.

CPC ..... *G07F 17/326* (2013.01); *A63F 3/06* (2013.01); *A63F 3/061* (2013.01); *A63F 3/064* (2013.01); *A63F 3/0605* (2013.01); *A63F 3/0625* (2013.01); *A63F 3/0645* (2013.01); *A63F 3/08* (2013.01); *G07F 17/329* (2013.01)

(58) Field of Classification Search

CPC ..... G07F 17/326; G07F 17/329; A63F 3/06; A63F 3/0605; A63F 3/061; A63F 3/0625; A63F 3/064; A63F 3/0645; A63F 3/08

USPC ..... 463/19

See application file for complete search history.

(56) References Cited

U.S. PATENT DOCUMENTS

| | | | |
|---|---|---|---|
| 5,338,042 | A | 8/1994 | Greer |
| 5,727,786 | A | 3/1998 | Weingardt |
| 5,788,237 | A | 8/1998 | Fults et al. |
| 6,059,659 | A | 5/2000 | Busch et al. |

(Continued)

FOREIGN PATENT DOCUMENTS

| | | | |
|---|---|---|---|
| WO | 2007035388 | A2 | 3/2007 |
| WO | 2008027062 | A1 | 3/2008 |

(Continued)

OTHER PUBLICATIONS

"U-PIK-EM Bingo Paper", Oct. 15, 2010, Bingo King, downloaded on Jun. 29, 2012 from <<http://www.web.archive.org/web/20101015142043/http://www.bingoking.com/paper/defaultasp?product=U-PIK-EM>>.*

(Continued)

*Primary Examiner* — Werner Garner
(74) *Attorney, Agent, or Firm* — Brooks Kushman P.C.

(57) ABSTRACT

Systems and methods for playing a game of chance include determining a winner based on the number of player indicia matching selected house indicia and continuing game play until at least one winner is determined. Embodiments include a fixed draw with prizes awarded to all players based on the number of player indicia matching house indicia, as well as a draw that continues until at least one player matches a predetermined number of house indicia. Embodiments include a player indicia selection device with available indicia arranged in rows having associated letters similar to a bingo flashboard. Player cards or tickets include at least some player indicia selectable by players, which may include players requesting an easy pick ticket with one or more randomly generated player indicia recorded at time of purchase.

47 Claims, 10 Drawing Sheets

(56) References Cited

U.S. PATENT DOCUMENTS

| | | | | |
|---|---|---|---|---|
| 6,267,670 | B1 * | 7/2001 | Walker et al. | 463/17 |
| 6,280,325 | B1 * | 8/2001 | Fisk | 463/19 |
| 6,565,091 | B2 | 5/2003 | Weingardt | |
| 6,652,378 | B2 | 11/2003 | Cannon et al. | |
| 6,698,755 | B2 | 3/2004 | Cherry | |
| 6,722,975 | B2 | 4/2004 | Duhamel | |
| 6,722,978 | B2 | 4/2004 | Valenti | |
| 6,780,108 | B1 | 8/2004 | Luciano, Jr. et al. | |
| 6,832,956 | B1 | 12/2004 | Boyd et al. | |
| 6,860,810 | B2 | 3/2005 | Cannon et al. | |
| 7,186,180 | B2 | 3/2007 | Lathrop et al. | |
| 7,204,756 | B2 | 4/2007 | Jubinville et al. | |
| 7,217,188 | B2 | 5/2007 | Byrne | |
| 7,258,608 | B2 | 8/2007 | Khal | |
| 7,270,604 | B2 | 9/2007 | Gerrard et al. | |
| 7,335,106 | B2 | 2/2008 | Johnson | |
| 7,452,270 | B2 | 11/2008 | Walker et al. | |
| 7,481,707 | B1 | 1/2009 | Luciano, Jr. et al. | |
| 7,494,413 | B2 | 2/2009 | Singer et al. | |
| 7,500,913 | B2 | 3/2009 | Baerlocher | |
| 7,500,914 | B2 | 3/2009 | Rodgers et al. | |
| 2002/0094860 | A1 * | 7/2002 | Itkis et al. | 463/19 |
| 2003/0040354 | A1 * | 2/2003 | Itkis et al. | 463/19 |
| 2003/0227134 | A1 * | 12/2003 | Khal | 273/269 |
| 2005/0192078 | A1 * | 9/2005 | Jawaharlal | 463/17 |
| 2007/0281774 | A1 | 12/2007 | Khal | |
| 2008/0176627 | A1 * | 7/2008 | Lardie | 463/20 |
| 2009/0124319 | A1 * | 5/2009 | Rader et al. | 463/13 |
| 2010/0184502 | A1 * | 7/2010 | Holch | 463/12 |
| 2010/0194044 | A1 * | 8/2010 | Sneek | 273/269 |
| 2011/0159941 | A1 * | 6/2011 | DeLise | 463/17 |

FOREIGN PATENT DOCUMENTS

| | | | |
|---|---|---|---|
| WO | 2008027443 | A2 | 3/2008 |
| WO | 2008027444 | A2 | 3/2008 |
| WO | 2008030739 | A2 | 3/2008 |
| WO | 2008030746 | A2 | 3/2008 |
| WO | 2009029101 | A1 | 3/2009 |

OTHER PUBLICATIONS

Scarne, John, "Scarne's Complete Guide to Gambling", 1961, Simon and Schuster, Inc., pp. 182-187.*

Bowser, Andrew, "How to Play Bingo", May 27, 2010, How Stuff Works.com, available at <web.archive.org/web/20100327190558/http://entertainment.howstuffworks.com/how-to-play-bingo.htm/printable>.*

DLTK's Printables BINGO Instructions, Jan. 2, 2010, DLTK-cards.com, available at <<http://web.archive.org/web/20100102005433/http://dltk-cards.com/bingo/instructions.htm>>.*

Casino-Game Program Instructions, 1979, Atari, Inc.*

OptimaSystem, Keno Game Management System—Las Vegas Gaming Inc. www.lvgi.com 4 pages.

Indian Gaming Classes Statute—Title 25—Indians Chapter 29—Indian Gaming Regulation Sec. 2703. Definitions—4 pages.

* cited by examiner

Fig. 17

1700 1702 1710 1712 1720 1704

Pick 8

| Catch | Odds | Prize |
|---|---|---|
| 8 | 22,939.11 | $50,000 + Progressive |
| 7 | 955.80 | $ 4,000.00 |
| 6 | 98.31 | $ 45.00 |
| 5 | 19.06 | $ 4.00 |
| 4 | 6.35 | $ 2.00 |
| 3 | 3.55 | $ - |
| 2 | 3.39 | $ - |
| 1 | 6.07 | $ - |
| 0 | 26.50 | $ - |

Fig. 18

1802 1804 1800 1810 1812 1820

Pick 8 ($3,000 Seed)

| Catch | Odds | Prize |
|---|---|---|
| 8 | 22,939.11 | Progressive |
| 7 | 955.80 | $ 90.00 |
| 6 | 98.31 | $ 8.50 |
| 5 | 19.06 | $ 1.50 |
| 4 | 6.35 | $ 1.00 |
| 3 | 3.55 | $ 0.45 |
| 2 | 3.39 | $ 0.45 |
| 1 | 6.07 | $ 1.00 |
| 0 | 26.50 | $ 2.00 |

SYSTEM AND METHOD FOR PLAYING BINGO

BACKGROUND

1. Field

Embodiments of the present disclosure relate to a gaming system and method for playing bingo and related games.

2. Background

Bingo is a game of chance played with randomly drawn articles typically having numbers or other indicia that players match against corresponding indicia on a player card or ticket. Traditional bingo games have numbers pre-arranged in a table, grid, matrix, or array, with winners determined by making a predetermined winning pattern with called numbers. The numbers may be printed on paper or cardstock, or electronically represented on a display with the subset of numbers for each play generally referred to as cards or tickets. When a single paper or other playing piece includes multiple cards, each may be referred to as a card face with the group of card faces referred to as a card or ticket. Players try to obtain the winning pattern or number of matches on their faces by covering or marking numbers on their cards as numbers are randomly selected or preselected from a predetermined group of numbers, such as 75 or 90 numbers, for example. Once a winning pattern is achieved or a predetermined number of calls are made, the game ends.

In contrast to keno, lotto, and related odds-based numbers games, regulations for bingo and related games generally include some requirement that the game must be played to conclusion. Although requirements may vary considerably by jurisdiction, this requirement is generally interpreted as requiring one or more winners. As such, if there are no winners in the prescribed number of calls, players continue to play for a consolation prize. Consolation prizes may be a fixed amount or a pari-mutuel prize based on the total or aggregate number and price of cards or tickets purchased by all players for that game. Payment of consolation prizes may be a significant operating expense for bingo gaming establishments. In addition, because of the uncertainty in the number of calls that may be required for a consolation prize winner, the use of consolation prizes to meet the requirement that the game be played to conclusion may reduce the total number of games that can be played in a given time period and thereby adversely affect scheduling of games and overall revenue for the operator.

Alternative methods of play have been developed to increase participation by creating excitement. Since its invention in 1934, modern bingo has evolved into multiple variations, with each jurisdiction's gambling laws regulating how the game is played. There are also nearly unlimited winning criteria that may be specified for playing a particular game. Some patterns only require one number to be matched whereas cover-all games require an entire card to be matched or covered to award the jackpot. Other games may award prizes to players for matching no numbers or achieving none of the specified patterns.

There are many variations of bingo games and even bingo cards. For example, double-action cards have two numbers in each square. However, the most common bingo cards are flat pieces of cardboard or paper that contain 25 squares arranged in five vertical columns and five horizontal rows. More recently, computer generated visual representations of bingo cards and related game cards or tickets may be presented on a screen or display. Each space in the grid contains a single number, except there may be one or more "Free" spaces, which typically include at least the center space. The "Free" spaces are considered covered or filled from the beginning of the game. For games played utilizing 75 numbers or another multiple of 5 numbers, the letters B, I, N, G, O may be pre-printed above the five vertical columns with one letter appearing above each column to assist players in more quickly locating a called number on their card(s). Players often play multiple cards for each game. For 75 number games, the numbers printed on the card are commonly arranged as follows: 1 to 15 in the B column; 16 to 30 in the I column; 31 to 45 in the N column; 46 to 60 in the G column and 61 to 75 in the O column. Depending on how many numbers are in each column for a particular game, the numbers are generally randomly selected from the number ranges above for each column. For example, a standard bingo game may include 25 spaces with 5 randomly selected numbers between 1 and 15 assigned to the B column, and so on. However, one variation randomly assigns the numbers to the available columns. In another variation, sometimes referred to as "U-Pick'Em" bingo, players may be issued three cards each having ⅓ of the total available numbers with all numbers that may be called or drawn included. Players then identify or mark which numbers they wish to play and then cover or mark the selected numbers when a corresponding number is called or drawn. Rather than a predetermined pattern, a predetermined number (such as 5 or 10) of matches to the called numbers determines a winning card.

With the expansion of Tribal gaming across the U.S., there are numerous versions of bingo that emulate the fast action of casino-like table games, but utilize the principals of bingo where players mark and monitor grid or matrix cards. Casino games like Roulette, Acey Duecy, and Money Wheel have bingo counterparts, which are permitted to be played under bingo licenses in many parts of the country. Similarly, U Pic'Em-style bingo is played in many markets, including in Native American bingo halls across the United States, and has been federally recognized as Class II gaming pursuant to the Indian Gaming Regulatory Act codified at 25 U.S.C. §2703. It is similar to keno in that players are seeking to match a specific set of numbers rather than a set of numbers that form a specific pattern on a bingo card. In keno, 20 numbers are drawn from a pool of 80 numbers. Players select 1 to 20 numbers and prizes are awarded based on the probabilities of matching a specific set or sets of numbers. Keno is strictly odds-based with a known theoretical chance to win. In contrast, U-Pic'Em bingo games generally have a pool of 75 or 90 available numbers or indicia rather than the 80 used in keno, and the number of indicia drawn is generally 24 rather than the 20 numbers drawn in keno. Unlike keno, a U-Pic'Em game may be combined or offered as a bonus in combination with a more traditional bingo game having a winning criterion associated with a pattern formed on a player card or ticket by the matched numbers in addition to the number of matched indicia, and played to conclusion, i.e. until at least one player wins a prize.

In some variants of U-Pic'em Bingo, a specific set of numbers (usually three or five) are not chosen by the player, but instead are pre-printed at the top of a bingo card. In other variations, players choose their numbers (usually six to eight) and write them down on two-part paper, depositing one part in a locked box and keeping the other part to track their numbers. This method generally requires manual verification and is rather time consuming and labor intensive for the operators. There may also be variations on the way(s) to win with the numbers. For example, one common method is if the first n numbers (usually in the three to five number variant) drawn during the course of the bingo game match the numbers a player has, the player wins a bonus prize that is above and beyond the prize for completing the winning bingo pattern(s). Other variations (more commonly found in the six to eight number variant) include awarding a prize to the player who matches the greatest number of indicia, or to all players who match specific numbers of indicia. The latter variant does not require the indicia be called as part of a session-based bingo game, is odds-based similar to keno, and facilitates play in locations that may not offer bingo, as well as those facilities that have more traditional bingo games.

Some jurisdictions do not recognize odds-based games as being bingo, though many do. However, odds-based games may still be classified as bingo or Class II gaming when players are competing against one another for a prize, or where a winner is determined and a prize awarded for every game as previously described. In addition to prize awards based on the number of player indicia matching called or house indicia, various patterns may be used to determine a winner for a particular game. In addition to a straight horizontal, vertical, or diagonal line, many bingo halls consider other patterns as a valid bingo, usually in special games. For example, a 2×2 square in the upper right-hand corner would be considered a "postage stamp". Another common special game requires players to cover each of the four corner squares. Games may also require two lines (double) or three lines (triple) to win. Combination games may have multiple bingos and/or winners based on different winning criteria, such as matching numbers or patterns of numbers. For example, the players first play to achieve a first winning pattern, such as a single line, to determine a first winner and then continue playing with the same cards and numbers to achieve a second winning pattern, such as a double line or coverall for a another prize.

The called numbers may be randomly selected using various methods for any of the variations of the game. With the expansion of computer technology, electronic random number generators (RNG) are now commonplace in many jurisdictions. However, some jurisdictions require physical draws that may utilize a randomly shuffled deck of bingo or other calling cards, a mechanical ball blower that mixes balls with blown air, or a cage that is turned to mix small wooden balls, for example. All methods essentially generate a sequence and/or group of random numbers for players to match to their card(s) or ticket(s).

In another version of play sometimes referred to as "Quick Shot", numbers are pre-drawn and players purchase sealed cards that are then matched against the pre-drawn numbers. If a specified pattern is achieved, then the player usually wins a prize according to a prize table. This is an odds-based, keno-like game that may be found on various Class II gaming devices manufactured by companies such as GameTech, Video King, Lightning Games, and others. Some versions are played until a player achieves a top level prize, and then new numbers are drawn and the game begins anew. This type of bingo may be played over days, weeks, or months depending on the difficulty of achieving a top level prize.

In "Bonanza Bingo" played with 75 numbers, typically 45 numbers are pre-drawn at the beginning of a bingo session. Players purchase sealed cards that are then matched against the pre-drawn numbers. At a designated time, the caller asks if anyone has a winning pattern or bingo. If no winners are identified, the caller then draws one more ball. This game is commonly played as a "progressive" game, where the jackpot increases as more cards are sold. If no one has achieved bingo after the single ball has been drawn, players then hold their cards for the next session of bingo, which may take place the following day or following week, for example. During each session thereafter, a single ball is drawn and players may continue to purchase additional sealed cards until someone achieves a cover-all.

Many bingo gaming establishments have a call board or flashboard with called numbers illuminated or displayed for the players to see previously called numbers. In U.S. style bingo using 75 numbers, the flashboard is often arranged in 5 rows of 15 columns with the numbers arranged in sequence from left to right. In a version referred to as "Horse Racing Bingo" up to 15 players are randomly issued a number from 1 to 15 corresponding to the top row of numbers on the flashboard. Numbers are then drawn and the first person to match all five numbers in their assigned column wins. This is a fast paced and exciting form of bingo typically played in fraternal organizations.

As previously described, various types of bingo games may use different types of progressive prizes. The first involves increasing a prize amount based on contributing a portion (either fixed amount or percentage) of each ticket sold to the progressive prize pool. Some progressive prize pools are increased per unit of time, such as a day, week, etc. Progressive prize pools may be grouped in different ways, including by winning pattern, days of the week, bingo session (time of day), etc. Some progressive prize games may change the contribution amount after the game starts and/or stop contributions once the prize reaches a certain value. Progressive prize pools may also be aggregated across multiple gaming locations.

In virtually all keno, lottery, bingo, and slot machines, the progressive portion of the prize is split when there are multiple winners. The progressive portion is the current amount of the progressive meter less the amount of the base jackpot. The progressive portion grows by allocating a portion of every wager to the progressive meter. Thus, when there are multiple winners, the progressive amount is generally split evenly among all winners. For example, a game starts with a base jackpot of $10,000. As players make wagers, a portion of each wager is added to the progressive meter causing it to grow to $14,000. If two people were to win the progressive jackpot during the same game, they would each be paid the base amount of $10,000 in addition to half of the progressive amount of $4,000 for a total prize award of $12,000. Additionally, in many instances the progressive prize is paid on an aggregate basis and would be split evenly among the winners for $7,000 each in this example.

The various styles of bingo and related games generally have some common features. For example, a particular game (i.e. winning criterion) ends when the first winner satisfies the winning criterion. In combined games, play may continue after a first winner, but the winning criterion and/or prize are changed for a second or subsequent winner, i.e. matching a group of player selected numbers and continuing play to match one or more patterns, such as a single line followed by double line, or a double line followed by a coverall. Similarly, because many jurisdictions require bingo and related games to be played to conclusion (in contrast to keno or lotto type games where it is acceptable to not have a winner), if there is no winner matching the winning criterion within the required number of calls, the winning criterion and/or prize may be changed for a consolation game that is played until a winner is determined, for example. Another common feature of the various games, including keno, lotto, and progressive style games, is that multiple winners generally split or share the prize.

SUMMARY

Systems and methods for playing a game of chance, which may be played as a standalone game of chance or in combination with another game of chance, have winning criteria associated with matching indicia such as objects, graphics, symbols, numbers, letters, or the like on a player card to indicia determined or selected by operator calls or an equivalent selection of game or house indicia identified by the gaming establishment, which may be generated manually by hand, ball cage, ball blower, playing cards, roulette wheel, etc., or electronically by a random number generator or the like, and selected and displayed individually and/or selected as a group during play and/or pre-selected prior to play. The systems and methods include determining a winner based on the number of player indicia matching house indicia and continuing game play until at least one winner is determined. Embodiments include a fixed draw with prizes awarded to all players based on the number of player indicia matching house indicia, as well as a draw that continues until at least one player matches a predetermined number of house indicia.

In one embodiment, each player selects a first predetermined number of player indicia from a pool having a second number of indicia and the selected player indicia are recorded on a player ticket. Various embodiments include player tickets and/or number selection devices with available numbers depicted as a bingo flashboard having five rows with each row associated with a designated bingo letter. In one embodiment, players may use a wireless mobile device, such as a cell phone or hand-held computing device to communicate selected numbers to a gaming operator. In another embodiment, the number selection device is implemented by a machine readable paper flashboard ticket. For each game, a third predetermined number of house indicia are selected from the pool by a gaming operator, and players are awarded a prize based on the number of player indicia matching the house indicia with either a prize awarded for every possible number of matching indicia or the game continuing until at least one player satisfies a winning criterion and is awarded a prize. House indicia may be generated manually by hand, ball cage, ball blower, playing cards, roulette wheel, etc., pre-selected, pre-called, or electronically called or sequenced by a random number generator or the like.

Various embodiments include a seeded prize with other embodiments played on a pari-mutuel basis with no seed money to begin the game. Similarly, seeded jackpot games as well as pari-mutuel games may include a progressive jackpot for a single location or aggregated across multiple gaming locations.

In one embodiment, a system for playing a game of chance includes a player indicia selection device that may be used by players to select and record some or all of the player indicia for one or more games on a player card or ticket. At least some player indicia may be preselected by the house or a third party in various embodiments. A first plurality of indicia is selected from a pool of a second plurality of indicia and recorded using the selection device. In one embodiment, the selection device includes all numbers of the pool arranged in rows and columns with each row having an associated letter, similar to a bingo flashboard. Embodiments include selection devices implemented by a paper flashboard that may be machine readable, as well as embodiments using a wired or wireless electronic device having a video display, such as a cell phone, handheld computing device, or dedicated gaming device. The system includes a house indicia device for determining or selecting called, game, or house indicia from the pool of indicia, and a display associated with the house indicia device for determining or selecting called indicia and displaying the called indicia, the display viewable by game players, wherein the system includes an associated pay table that determines prize awards for specified winning criteria. In one embodiment, the pay table includes a prize for every possible outcome or number of matches after a predetermined number of house indicia have been selected so that every game is played to conclusion and at least one winner is determined. In another embodiment, the pay table includes prize awards for a subset of possible outcomes and the game continues with additional house indicia selected until at least one player satisfies a winning criterion to conclude the game.

Systems and methods for gaming according to embodiments of the present disclosure have a number of associated advantages. For example, flashboard bingo and related gaming according to the present disclosure provides players more fun and excitement and reinvigorates operator revenues. Gaming strategies according to the present disclosure may be used to eliminate consolation prizes or to shift responsibility for consolation prizes and/or other prizes from the game operator to a third-party. Similarly, pay tables and progressive prize awards may be adjusted for particular player demographics and/or operator requirements. Various embodiments of flashboard bingo and related gaming according to the present disclosure provide a computerized ticket/card issuing and tracking system to reduce or eliminate manually matching of tickets. The computerized system may be used to manage and account for multiple progressive jackpots at a single gaming location and/or linked progressives across multiple locations. Embodiments may also include a computerized gaming system that facilitates player tracking to collect and analyze player demographics and behavior. In addition, a digital content manager may be provided to facilitate full motion video advertising on player video devices. Embodiments according to the present disclosure allow operators to generate more profit and eliminate prize exposure in favor of a fixed cost per ticket such that profits increase with increased ticket sales.

Gaming strategies according to the present disclosure may be applied to virtually any existing or future variations of bingo and similar games of chance. Various embodiments may be used with any winning pattern, combination, or number selections and the like. Cards or tickets may comprise paper, card stock, fixed, portable, or handheld electronic displays, and the like. Embodiments according to the present disclosure may be applied to fixed odds payouts, pari-mutuel, progressive, or any combination thereof. Similarly, embodiments may also be played with any approved method of determining, selecting, or calling house or game indicia such as numbers, words, or other elements to be matched including but not limited to pre-called games, random number generators, ball blowers, card draws, roulette style draws, and the like.

Various embodiments of flashboard bingo and related games may be played with at least one player that is playing one or more card faces or selection of indicia. Multi-player implementations may be required in some jurisdictions. For example, Class II gaming may require the game to be played with at least two players. The flashboard bingo and related games according to the present disclosure may also be used in various computer or machine based implementations.

An implementation of flashboard bingo in which prize amounts are offered for all possible outcomes provides a means for effectively offering a pari-mutuel game without requiring the use of meters to increment the prize values. The fixed odds payouts provide the operator with a known theoretical cost for each selection of indicia The above advantages and other advantages and features will be readily apparent from the following detailed description of the preferred embodiments when taken in connection with the accompanying drawings.

BRIEF DESCRIPTION OF THE DRAWINGS

Embodiments of the present disclosure described herein are recited with particularity in the appended claims. However, other features will become more apparent, and the embodiments may be best understood by referring to the following detailed description in conjunction with the accompanying drawings, in which:

FIG. 17 illustrates a representative pay table having a house hold and progressive jackpot for use with flashboard bingo or a related game of chance according to embodiments of the present disclosure; and FIG. 18 illustrates a representative pay table having a seeded prize with prize amounts for all possible outcomes for use with flashboard bingo or a related game of chance according to embodiments of the present disclosure.

DETAILED DESCRIPTION

Figure 1:
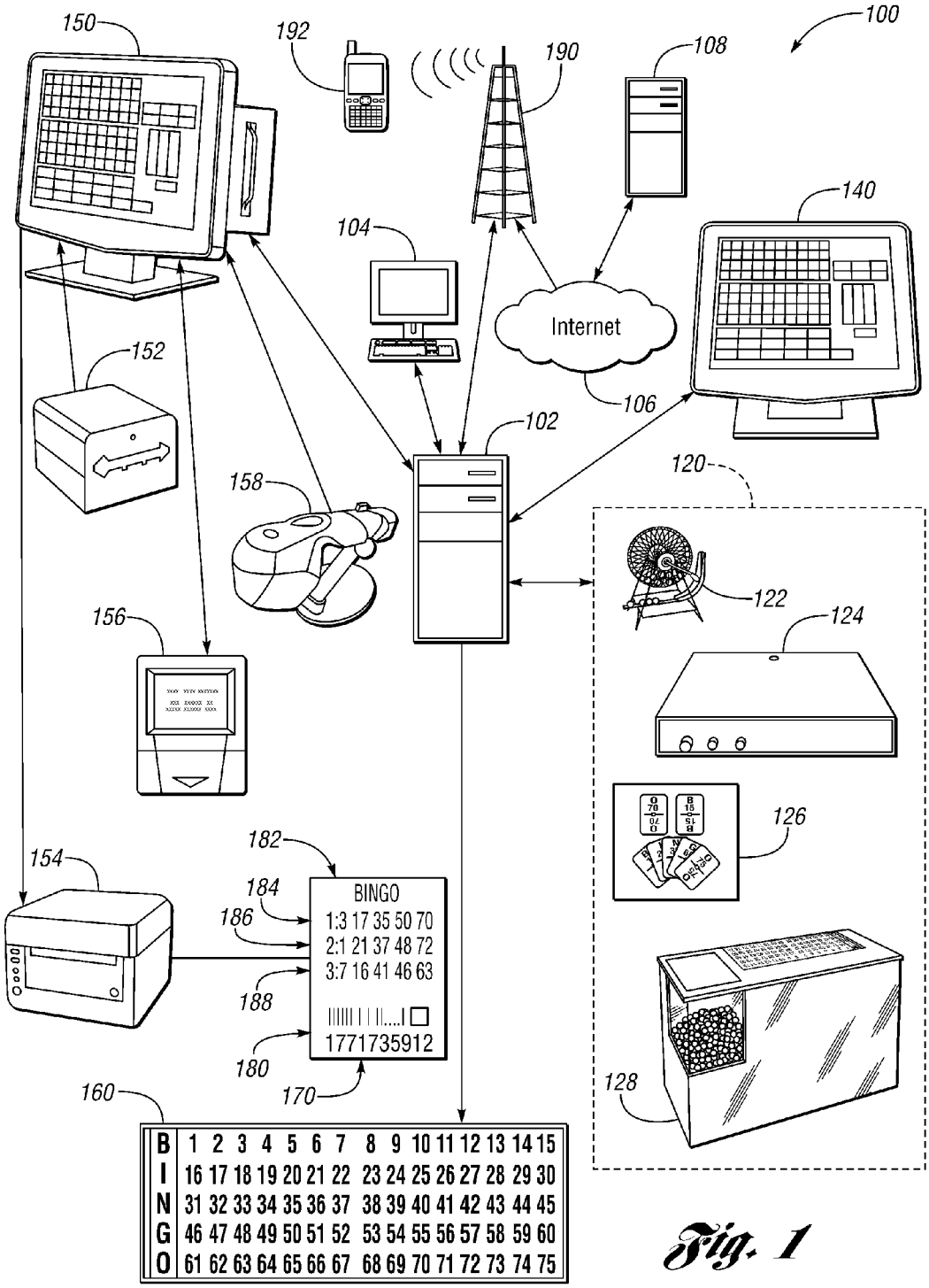
FIG. 1 is a block diagram illustrating operation of a system or method for playing a game of chance to conclusion having at least some player selectable indicia according to various embodiments of the present disclosure.

As those of ordinary skill in the art will understand, various features of the embodiments illustrated and described with reference to any one of the Figures may be combined with features illustrated in one or more other Figures to produce embodiments that may not be explicitly illustrated or described in detail. The combinations of features illustrated provide representative embodiments for typical gaming applications for bingo and related games. However, various combinations and modifications of the features consistent with the teachings of the present disclosure may be desired for particular applications or implementations. The representative embodiments used in the illustrations relate generally to a game of chance, such as bingo or a related game, with multiple prizes and/or winners. Those of ordinary skill in the art may recognize similar games or other applications or implementations not specifically described, but that are within the scope of the claims.

The descriptions of various styles of bingo and related gaming are purely illustrative. The systems and methods for gaming according to various embodiments of the present disclosure are generally independent of the size of the pool of indicia and are not limited to the 75 or 90 indicia, elements, balls, or numbers used in traditional bingo as played in the United States or Europe as described with respect to various representative embodiments. In addition, those of ordinary skill in the art will recognize that any reference to balls or ball calls apply equally to games where other indicia such as letters, words, names, symbols, constellations, figures, patterns, and the like may be used in place of, or in combination with numbers In general, the flashboard bingo strategies described with reference to various embodiments of the present disclosure are independent of the particular manner or strategy for selecting, determining, sequencing, calling, etc. of the house or game indicia. As such, the winning combination, matched selection, number of matches, etc. may generally be obtained by any predetermined or random selection of indicia using manual, electrical, mechanical, electronic, or computer controlled or assisted devices to match less than or equal to the total number of possible selections. Likewise, operator calls, house or game indicia may be determined, selected, or sequenced individually one at a time, and/or in groups or sets and subsequently displayed or otherwise provided to game players. Whether selected individually or as a group or set, house or game indicia may be displayed or presented individually and/or as a group. For example, a group of game or house indicia may be pre-selected prior to the beginning of a game and displayed or presented as a group to the players. Subsequent selection and presentation may occur for individual calls in substantially real time during game play. As another example, all of the available pool of indicia may be pre-selected or sequenced prior to game play and then called or presented individually to the game players to determine prize awards as described herein.

Those of ordinary skill in the art will recognize that the flashboard bingo strategies illustrated in various embodiments of the present disclosure may be applied to virtually any existing or future variation of bingo and related games. The strategies may be used with any winning pattern, combination, number selections, and the like. Similarly, various embodiments of the present disclosure may be played with tickets or cards on paper, card stock, or electronically via a video screen on a kiosk or handheld device, for example. Flashboard bingo strategies according to embodiments of the present disclosure may be applied to games based on fixed odds payouts, pari-mutuel, progressive jackpots, or any combination thereof. Similarly, although various embodiments may refer to a ball call, an operator call or more generally selection or determination of house or game indicia, the flashboard bingo strategies illustrated may be used in games that incorporate various methods for selecting or determining house or game indicia, which may include a number, letter, word, graphic, picture, etc., including but not limited to pre-called games, random number generators, ball blowers, card draws, roulette style draws, and the like.

FIG. 1 is a block diagram illustrating operation of a system or method for playing a game of chance such as flashboard bingo or a related game according to various embodiments of the present disclosure. System 100 includes a computer server 102 in communication with various local and/or remote client devices using standard communication protocols, which may include secure, encrypted communications. Computer server 102 performs various functions associated with operation, management, and reporting for flashboard bingo and related games of chance as described in greater detail herein according to various embodiments of the present disclosure. Computer server 102 may be connected via a local and/or wide area network using any of a number of standard wired and/or wireless connection technologies. A management or administrator terminal console or computer 104 may be used to manage various game related operations performed by computer server 102. Computer 104 may be directly connected to server 102, or may be connected via a public or private network, such as the internet, generally represented by 106. Computer server 102 may also be connected to one or more computers 108, which may include one or more website servers and/or gaming servers at one or more gaming establishments or properties, for example, via a private network and/or the internet 106. Computer server 102 may control and/or coordinate games for multiple gaming establishments or properties to facilitate multi-property progressive prizes, for example. One or more website servers 108 may be used to remotely play flashboard bingo or a related game of chance where regulations permit. Similarly, a website server 108 may provide status information for player tickets/cards to allow players to obtain information relative to multi-game tickets as described in greater detail herein.

Gaming devices used in a system or method for flashboard bingo and related games of chance according to the present disclosure may include at least one device as generally represented by reference numeral 120 for selecting house indicia or called objects from a pool of available objects for a particular game. For example, device 120 may be implemented by one or more of a ball cage 122, an electronic or computer controlled random number generator (RNG) 124, a deck of cards 126, or a ball blower/console 128, although typically only one device is used in any particular game. RNG 124 may be implemented by a dedicated hardware device with associated embedded software. Alternatively, RNG 124 may be implemented entirely in software executing on computer server 102 or another computer or server. In one embodiment, RNG 124 is implemented by a dedicated hardware device or network appliance that communicates via a standard network protocol, such as Ethernet, and supports multiple games at multiple locations with house/game draws of between two and one-hundred-twenty numbers. RNG 124 may be programmed via hardware, software, or firmware, to provide a particular range of numbers and numbers of draws for a particular application. For example, in one embodiment of flashboard bingo according to the present disclosure, RNG 124 provides 24 randomly generated numbers having values between 1 and 75 for each game similar to a traditional bingo draw. Additional draws or numbers may be provided to play the game to conclusion depending on the particular implementation as described in greater detail herein.

Although various house indicia selection devices or methods may have advantages over others, those of ordinary skill in the art will recognize that the present disclosure is independent of the particular type of device 120 or method used to select, sequence, or otherwise determine house indicia represented by called numbers or objects as previously described. Depending on the particular device used to select or otherwise determine house indicia, the selected indicia may be manually entered by an operator and/or automatically determined and communicated to computer server 102 in near real time and/or as a group upon conclusion of a game or at other selected intervals. For example, a ball blower console 128 may be used to manually draw each number. Each ball drawn is electronically or otherwise detected by console 128 or an associated device, and communicated to computer server 102. In applications having an RNG 124, selected house indicia are automatically communicated to server 102 in response to a particular request, which may be manually or automatically initiated. For example, an operator may initiate an electronic ball draw via an associated touch screen display 140 or similar device as illustrated and described herein. Alternatively, touch screen 140 may be used to enter ball calls determined using a manual device, such as ball cage 122, cards 126, ball blower 128, or the like, which are then communicated to server 102. In one embodiment, a desk terminal implemented using touch screen 140 with embedded software facilitates various game functions, such as game close, clear boards, and re-display, for example. In other embodiments, server 102 may automatically generate a request for multiple draws when a game is initiated. Of course, various other manual and/or automatic strategies for selecting or otherwise determining house indicia may be used.

As also shown in FIG. 1, system 100 may include one or more writer terminals 150 to facilitate various game-related functions. In one embodiment, writer terminal 150 is a client device implemented by a touch-screen display with embedded software to provide a user interface to control gaming functions and communicate with computer server 102. Terminals 150 may be located at multiple gaming establishments and communicate with a single centralized server 102. A representative user interface for a writer terminal used in flashboard bingo or related games of chance is illustrated and described in greater detail with reference to FIG. 13. Writer terminal 150 may also include an integrated secondary customer display. Various accessories may also be connected to writer terminal 150. For example, a magnetic card reader may be provided to read player affinity cards, credit cards, and similar cards to track player habits. In addition, a fingerprint reader may be provided to enhance login security for operators of writer terminal 150. As previously described, writer terminal 150 may communicate with server 102 and one or more peripheral devices directly and/or using any standard communication protocol such as Ethernet, for example. Writer terminal 150 may also include cash register features such as subtotal, total, and tender. A single writer terminal 150 may be used to provide gaming functions for any of a number of games being coordinated by server 102.

Writer terminal 150 may be directly connected or otherwise in communication with various peripheral or accessory devices such as a mark sense reader 152 and ticket/card printer 154, for example. Reader 152 may be used to automatically read player tickets/card requests, which may include one or more player requested indicia. In one embodiment, players may request numbers printed on a paper ticket request by marking the paper with a pen or pencil. The ticket request is then fed into reader 152 which reads the marks and communicates associated information to writer terminal 150. As described in greater detail below, writer terminal 150 communicates this information to server 102. The ticket/card request form may include all available numbers depicted as a bingo flashboard, for example, as generally represented by flashboard 160. Of course, various other arrangements may be provided. For example, a ticket request may only include numbers written by hand by the player. Ticket requests may be presented to an operator with requested player indicia automatically and/or manually entered via writer terminal 150 as described in greater detail herein. However, use of a machine-readable ticket request in combination with a corresponding device such as reader 152 reduces or eliminates errors associated with manually selecting player indicia requested by a particular player. Upon collecting an associated wager and verifying ticket information, a paper ticket or card 170 may be printed by printer 154. Alternatively, or in combination, a virtual ticket/card may be provided in electronic form to an associated display on a player terminal and/or handheld device, such as cell phone 192. As also illustrated in FIG. 1, printer 154 may be directly connected to writer terminal 150 and or server 102 via a wired or wireless connection. Alternatively, or in combination, one or more printers 154 may be networked to one or more writer terminals 150 and/or server 102 and distributed at convenient locations throughout a gaming establishment depending upon the particular application and implementation.

Figure 16:
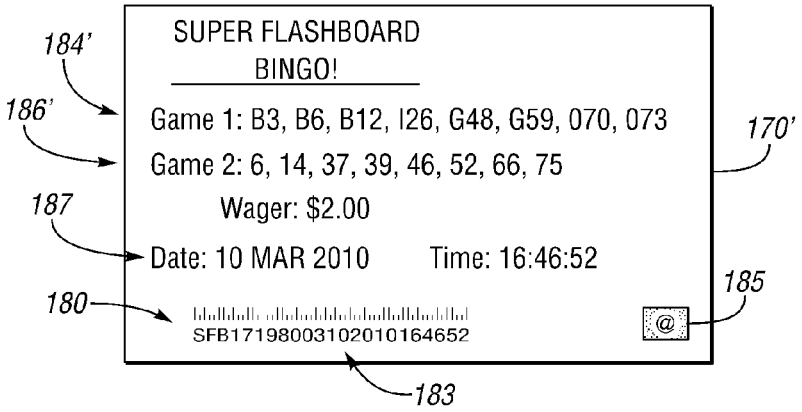
FIG. 16 illustrates a representative ticket or card for use in flashboard bingo or a related game of chance according to embodiments of the present disclosure.

System 100 includes a plurality of player cards or tickets 170 (as also shown and described with respect to FIG. 16). The actual type, arrangement, and content of player cards 170 may vary by the game being played. Cards may have various common features, such as a game identifier 182 and indicia or objects 184, 186, 188 (numbers in this example) that may include multiple wagers and/or multiple games with one or more player selected indicia. For example, wagers 184, 186, 188 may represent multiple wagers for a single game. Alternatively, each group 184, 186, 188 of player indicia may represent wagers for three different games. Alternatively, the three wagers may apply to multiple future games at various intervals, such as one a day, one a week, ten per day, etc. In one embodiment, player requested or selected indicia include randomly generated numbers produced in response to a player request for a quick pick card or ticket. Cards 170 may also include computer readable indicia, such as a machine readable identification and/or security code 180. For example, computer readable indicia may include a linear or two-dimensional bar code, machine readable numbers, magnetic stripe, etc. Similarly, card 170 may include human readable numbers and/or letters associated with a machine-readable symbol or barcode to identify a particular ticket or card. Various other information may also be printed on cards 170, such as the amount of a wager, session ID, number of games, date, etc. depending on the particular implementation. Of course, arrangements of numbers or indicia other than those shown or described are possible and contemplated within the scope of this disclosure. Cards 170 generally include a first plurality of indicia, 5 numbers in this example, selected from a pool of a second plurality of indicia, such as 75 numbers, for example. Some or all of the player indicia may be selected or requested by the player, with any remaining player indicia randomly generated by the house using a software and/or hardware random number generator (RNG) or similar device. The indicia may be prearranged in a particular order or pattern, such as from low to high, or associated with a particular bingo letter, for example. Player cards 170 may be physically implemented on paper, cardstock, or similar material, or may be electronically or virtually represented on a fixed, portable, or handheld electronic device having a display, such as a player terminal or cell phone 192, for example. In one embodiment, cards 170 are implemented as cards having player indicia preselected and concealed by pull tabs. In this embodiment, house indicia may be preselected prior to the beginning of the game. Players open the pull tabs to reveal the player numbers or other designations on player card 170. The prize award may be determined based on the number of pull tabs opened by the player to match the previously designated number of numbers or other designations.

Various accessories or peripherals may also be provided as generally represented by card/ticket checker 156, barcode scanner 158, and display or flashboard 160. Ticket checker 156 may include a barcode reader in addition to a magnetic stripe reader. The magnetic stripe reader may be used to read a customer affinity program card and display associated information, for example. Ticket checker 156 is a player activated device that may be used to scan a ticket and determine the ticket ID and display the status of that ticket. For example, ticket checker 156 may scan the barcode on a ticket to determine the ticket ID. The ticket ID information is communicated to server 102 to determine the status of the ticket. Ticket status is returned to ticket checker 156 and displayed on an embedded display. Ticket status may include a variety of information related to the game or games associated with the particular ticket, such as the date and time the ticket was issued, the wager, the time of completion of associated games, any winnings, and the like. Barcode scanner 158 may also be used to scan or read machine-readable information encoded on a ticket/card. Information is communicated to server 102 to identify the ticket. Associated information stored in a database in server 102 may then be communicated to any associated terminal or display.

Flashboard 160 may be used to present or display house indicia to players within a gaming establishment. While illustrated as a dedicated display, flashboard 160 may be alternatively implemented by a general-purpose display. Similarly, house indicia may be communicated in various other formats depending upon the particular application and implementation. In addition to a local display, house indicia may be presented to players via wireless devices such as cell phone 192. Wireless devices may communicate with server 102 via an associated antenna or tower 190. Antenna or tower 190 generally represents any wireless transmitting device such as a wireless router, cell phone tower, and the like. Alternatively, or in combination, house indicia and other related gaming information may be presented to one or more computers or servers 108 via the Internet 106 and/or any local private or public networks. Likewise, any devices illustrated in FIG. 1 may communicate with server 102 using a wireless connection.

In operation, a game of chance, such as flashboard bingo or a related game, is played for prizes, including monetary prizes, with cards/tickets 170 bearing numbers or other designations. Players or cardholders may cover the selected numbers or other designations when objects similarly numbered or designated as represented by balls 122, 128, or cards 126, for example, are drawn or electronically determined, such as by random number generator 124. Depending upon the particular implementation, the game may be won by the first person covering a previously designated number of numbers or other designations on card 170, which may include at least some of the player numbers or other designations selected by a player. Numbers or other designations may be selected using a printed or electronic representation of a bingo flashboard as generally represented by flashboard 160, for example. In one embodiment, at least some of the numbers or other designations are selected by a player using a handheld mobile device, such as cell phone 192, for example. Numbers may be requested or selected by a player using a standard text messaging protocol, such as SMS or a similar protocol, for example. Similarly, players may request one or more player indicia for a particular card/ticket by marking or requesting a quick pick, for example. In this case, the player requested indicia are randomly generated by server 102 and/or an associated random number generator 124. In one embodiment, the game is played to conclusion by continuing to draw or electronically determine objects until at least one cardholder covers the previously designated number of numbers or other designations. Alternatively, the game ends after a fixed number of draws by awarding every cardholder a prize associated with the number of numbers or other designations covered after the predetermined number of objects are drawn. In one embodiment of flashboard bingo, 24 numbers or other designations are drawn or electronically determined from a pool of 75 numbers or other designations with a prize awarded for every card corresponding to the number of numbers or other designations covered after the 24 numbers or other designations have been drawn.

Prizes are awarded based on an associated pay table stored within server 102 as explained in greater detail herein. Prize awards may be determined on a pari-mutuel basis based on wagers made less a designated house portion. Alternatively, prize awards may include a seeded prize beginning at a minimum value and increasing based on a cumulative amount of wagers or other meter until a winner is determined. As previously described, a ticket/card may be valid for a predetermined number of future games based on a corresponding wager amount for each game.

Figure 2:
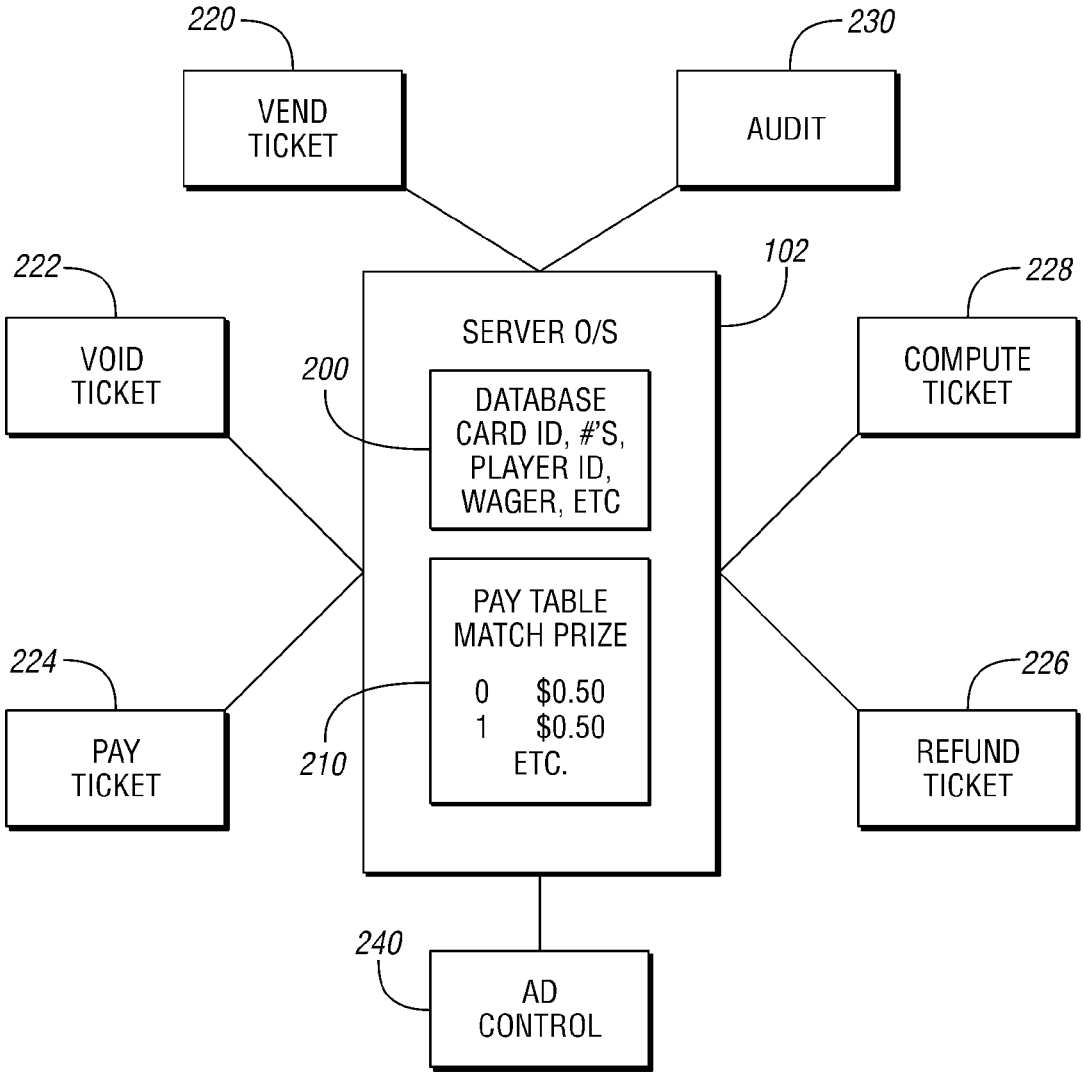
FIG. 2 is a block diagram illustrating representative operations of a system or method for playing flashboard bingo according to embodiments of the present disclosure.

FIG. 2 is a block diagram illustrating representative functions performed by server 102 for flashboard bingo or a related game of chance according to various embodiments of the present disclosure. Server 102 may include a database 200 containing various game related data such as card/ticket ID and associated player indicia, wager, player ID, date and timestamp, and the like. Server 102 may also include one or more pay tables 210 for determining prize awards associated with a particular game and number of matching player indicia. Representative pay tables are illustrated in FIGS. 17 and 18. Server 102 may be used to operate and manage one or more games simultaneously. In one embodiment, server 102 operates and manages up to 16 different games simultaneously. Server 102 may support wide area, multi-property linked progressive games and may contain up to 120 different pay tables in 32 progressive meters, for example. Of course the number of simultaneous games, pay tables, and progressive meters may vary depending on the particular application and implementation. Server 102 may include software to provide player tracking for player affinity programs as well as an embedded random number generator implemented in software. Server 102 may support encrypted communications using various protocols and/or encryption algorithms such as 64-bit DES and/or 256 bit AES, for example. Support for socket communications facilitates networking to a variety of devices as illustrated and described with reference to FIG. 1, for example.

Representative functions for operating and managing flashboard bingo or a related game of chance may include vending a ticket 220, voiding a ticket 222, paying a ticket 224, refunding a ticket 226, and computing a ticket 228, for example. Various other functions, such as an audit function 230 and advertising control function 240, for example, may also be provided. Of course the functions illustrated in FIG. 2 are representative only and various implementations may include additional functions, or may omit various functions.

Figure 3:
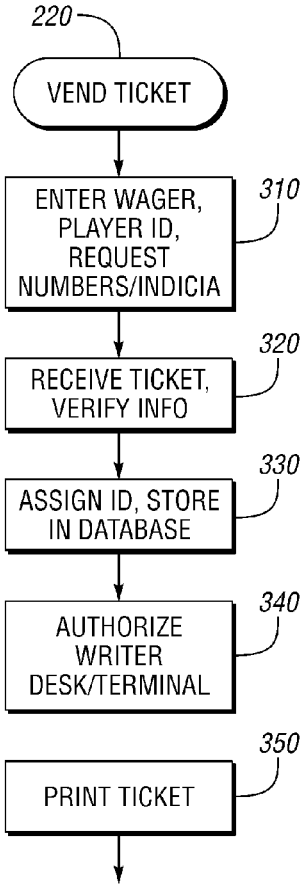
FIG. 3 is a flowchart illustrating operation of a representative vend ticket function in a flashboard bingo game or related game of chance according to embodiments of the present disclosure.

FIG. 3 is a block diagram illustrating operation of a representative ticket vending function 220. The transaction may be initiated by entering a wager as generally represented by block 310. This may include optionally entering a player ID or account to provide player tracking and any benefits associated with a player affinity program, for example. In addition, in some embodiments, players may request player indicia or numbers for a particular ticket/card. The wager and requested player indicia may be entered manually by an operator at a writer terminal, or may be entered via a handheld wireless device such as a cell phone or player terminal, for example. The requested player indicia and associated information is received by the game server as represented by block 320. The server verifies permissions and verifies that the wager is appropriate for the particular game. Wager verification may include various bet limits and the like as determined by the system configuration and pay tables, for example. Valid tickets are assigned a corresponding ID and the information is committed to the appropriate ticket database and/or other related databases as represented by block 330. Various data integrity techniques may be used to assure that a particular transaction is completely saved to disk or not at all. After the transaction has been saved, the ticket/card is authorized as represented by block 340. The authorization may be sent to a writer terminal along with the associated ticket ID and may include pricing adjustments for a particular wager based on a player affinity program, for example. The ticket/card may then be printed using the writer terminal and an associated printer. Alternatively, ticket information may be sent to a fixed, portable, or handheld electronic device having a display, such as a player terminal, cell phone, or PDA, for example. The ticket information may include a barcode, serial number, or related security information as previously described.

Figure 4:
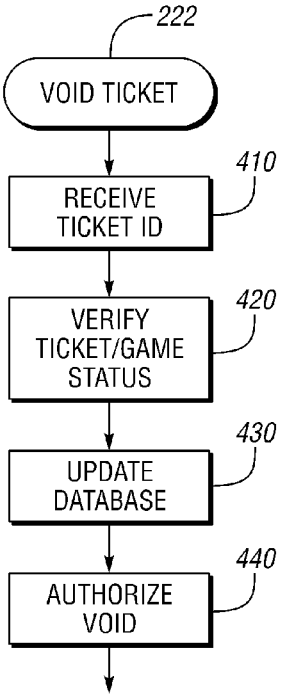
FIG. 4 is a flowchart illustrating operation of a representative voice ticket function for a flashboard bingo game or related game of chance according to embodiments of the present disclosure.

FIG. 4 is a flowchart illustrating a representative void ticket function for a flashboard bingo or related game of chance according to various embodiments of the present disclosure. Ticket information may be entered using a writer station, for example, either manually or by scanning machine-readable information associated with the ticket. The ticket identification information is received by the server as represented by block 410. The server may verify that the operator of the writer station has appropriate permission to void a ticket. In addition, the server verifies that the ticket is voidable, meaning that the game for which the ticket applies has not been closed as generally represented by block 420. The server updates the databases affected by the voided ticket transaction including the ticket database and related databases as represented by block 430. Data integrity strategies may be used to assure that the transaction is completed and properly saved. Upon completion, the server authorizes the void as represented by block 440 and may transmit the information to the associated writer terminal. The writer terminal may then print the ticket and update the void totals using an associated printer, for example.

Figure 5:
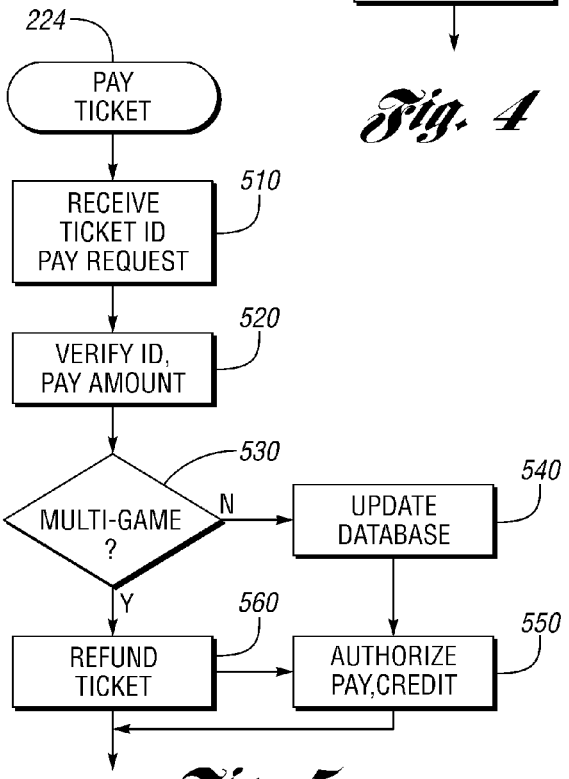
FIG. 5 is a flowchart illustrating operation of a representative pay ticket function for a flashboard bingo game or related game of chance according to embodiments of the present disclosure.

A flowchart illustrating operation of a representative pay ticket function for a flashboard bingo or related game of chance is shown in FIG. 5. The pay ticket function 224 begins by entering the ticket ID, which may be manually entered at a writer station and/or computer readable indicia may be scanned using an associated scanner. The ticket information and pay request are communicated to the server as represented by block 510. The server may verify that the operator of the writer station has the appropriate permission to pay tickets, that the prize award is within a limit associated with the operator and/or terminal, and that the ticket is payable as generally represented by block 520. If the ticket is a multi-game ticket with remaining games as represented by block 530, a ticket refund request is generated as represented by block 560 and described in greater detail with reference to FIG. 6. Otherwise, the appropriate databases are updated as represented by block 540 and an authorization to pay the associated prize award or credit an associated account is generated as represented by block 550. The pay authorization may be communicated to the associated writer station, which may then print a pay receipt on an associated printer, for example. The pay receipt may be used to collect the winnings from a centralized cashier station, for example.

Figure 6:
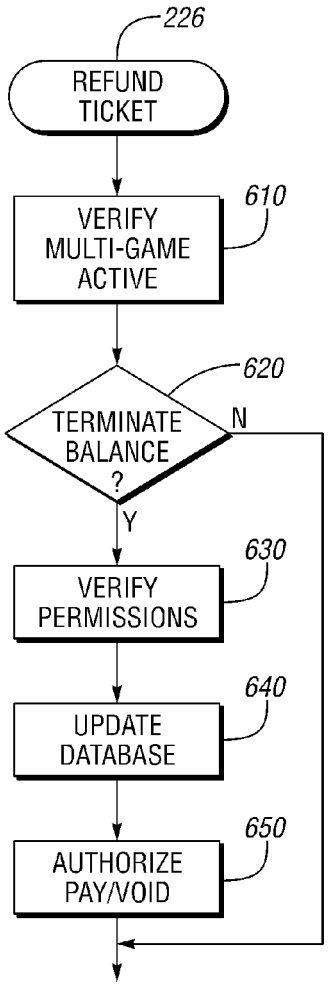
FIG. 6 is a flowchart illustrating operation of a representative refund ticket function for a flashboard bingo game or related game of chance according to embodiments of the present disclosure.

FIG. 6 is a flowchart illustrating operation of a representative ticket refund function 226 for flashboard bingo or a related game of chance according to various embodiments of the present disclosure. The ticket ID is used to verify that the ticket is a multi-game ticket with games remaining as represented by block 610. An associated writer terminal may be notified of the ticket status with associated information presented to the player such as the number of games or races remaining and the current prize winnings associated with the ticket. The player may be prompted with a request to proceed with the transaction and terminate the balance of play as represented by the block 620. If the transaction is canceled, no further action is taken. Otherwise, the ticket refund proceeds by verifying the operator permissions and associated limits as represented by block 630. The server updates associated databases as represented by block 640. Upon completion of the database update, a refund message may be indicated to the writer with the associated prize award amounts and the amount of the voided portion of the ticket as represented by block 650. The writer station may then print any associated refund receipt using an attached or networked printer.

Figure 7:
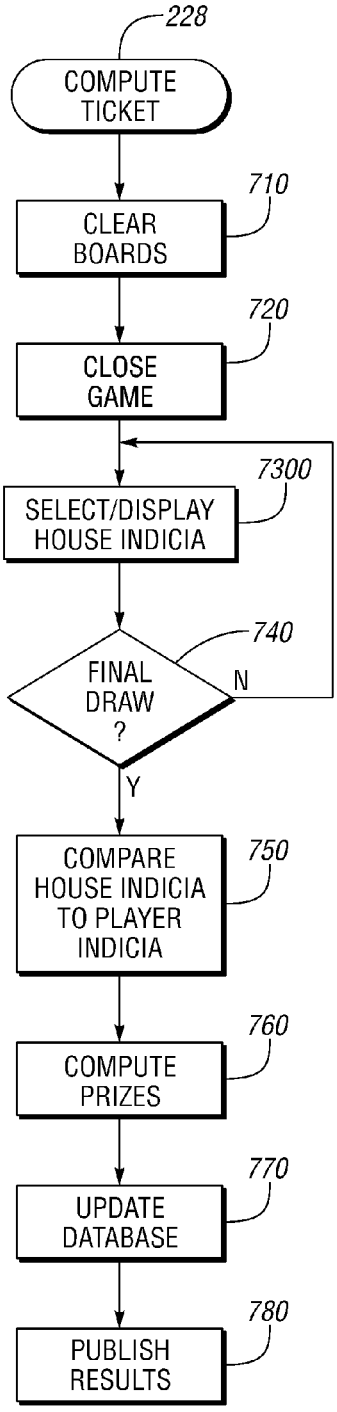
FIG. 7 is a flowchart illustrating operation of a representative compute ticket function for a flashboard bingo game or related game of chance according to embodiments of the present disclosure.

FIG. 7 is a flowchart illustrating a representative compute ticket function for a flashboard bingo or related game of chance according to various embodiments of the present disclosure. Compute ticket function 228 begins when the game operator clears the boards from a desk station or from the game server as represented by block 710. If a desk station or other terminal is used, the clear boards message is communicated to the server, which in turn sends appropriate messages to the display devices to clear the board of balls and display the current game. The game operator closes the game from a desk station or directly from the server/console as represented by block 720. Upon receiving the game close message, the server performs various actions such as notifying the various display devices that the current game is closed. The display devices display an appropriate message along with a closing game number. Depending on the particular type of display device, a sound clip or video may also be played upon closing of the game. House indicia is then selected and/or displayed as represented by block 730. As previously described, some or all of the house indicia may be preselected prior to beginning the game. In that case, the preselected house indicia may be displayed sequentially and/or as a group as represented by block 730. House indicia may be selected using an associated random number generator or other device as previously described with respect to FIG. 1, for example. For manually drawn games, the game operator communicates each draw to the server using an associated terminal or other device as previously described. The game continues until the final draw is performed as represented by block 740.

When the server receives the final draw as represented by block 740, the player indicia on all active tickets are compared with the selected house indicia to determine matches for each ticket as represented by block 750. The associated pay table (or tables for combination or consecutive games) is then used to compute prizes as represented by block 760. Depending upon the particular implementation, the total of all winners may be compared to an aggregate limit. If the aggregate limit is exceeded, each ticket win amount may be adjusted to prevent the total of all winners from exceeding the aggregate limit. If the total of progressive meter payments exceed the meter amount, the meter portion of ticket winners may be adjusted so that the total of the meter win amounts does not exceed the associated limit. After completing the calculations, the associated databases are updated as represented by block 770. The game results may then be communicated to one or more display devices, websites, handheld mobile devices, and the like as represented by block 780.

Figure 8:
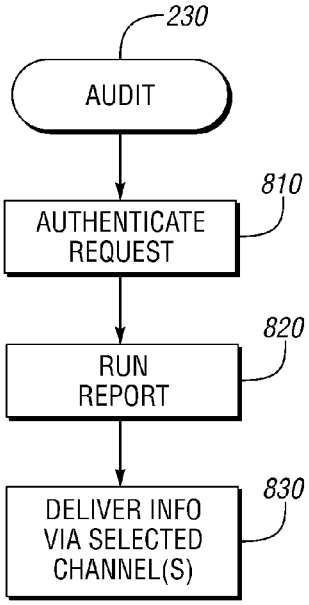
FIG. 8 is a flowchart illustrating operation of a representative audit function for a flashboard bingo game or related game of chance according to embodiments of the present disclosure.

A flowchart illustrating operation of a representative audit function for flashboard bingo and related games of chance according to various embodiments of the present disclosure is shown in FIG. 8. Audit function 230 may begin by authenticating an associated request as represented by block 810. Authentication may include verifying a user ID and password and/or identification of a device requesting an audit report. Depending upon the particular implementation, a hardware key, fingerprint data, or other security verification may be required. An audit request may be communicated using a local terminal or over a network depending upon the particular implementation. After authenticating an audit request as represented by block 810, various other functions may be performed as represented by block 820. One or more reports may be generated and displayed and/or printed and delivered to an associated device or devices as represented by block 830.

Figure 9:
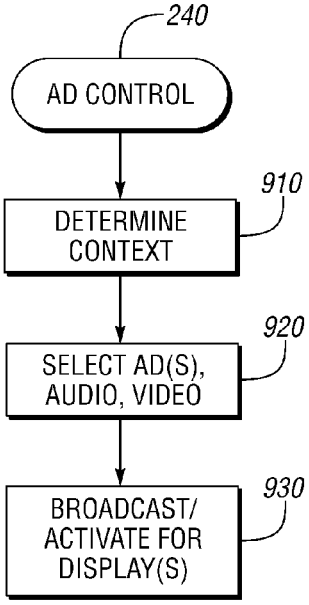
FIG. 9 is a flowchart illustrating operation of a representative advertising control function for a flashboard bingo game or related game of chance according to embodiments of the present disclosure.

FIG. 9 is a flowchart illustrating a representative advertising control function for flashboard bingo and related games of chance according to various embodiments of the present disclosure. As previously described, advertising may be presented to players using associated terminals during play and/or between games. Advertising control function 240 begins by determining the context of a particular display or group of displays as represented by block 910. The context may include whether a game is active, the particular game being played, the player ID, and related information, for example. One or more advertisements may be selected based on the current context as represented by block 920. Advertisements may include still images, full-motion video, and/or audio presented individually or in combination. Selected advertisements are broadcast to associated display devices as represented by block 930.

Figure 10:
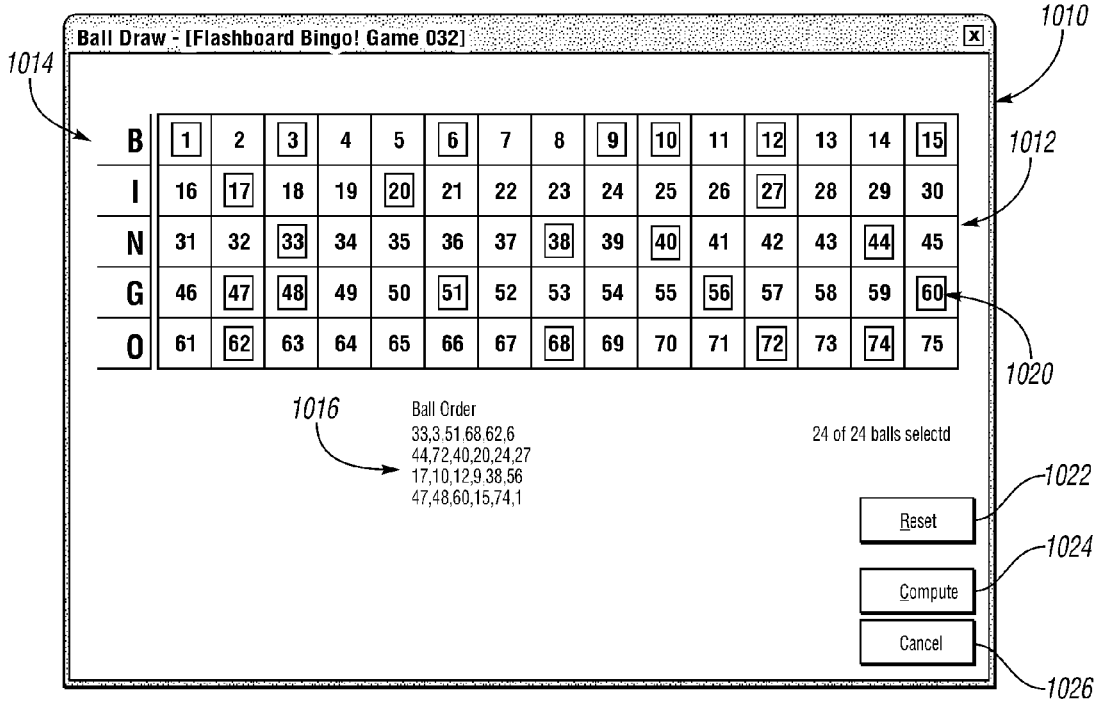
FIG. 10 illustrates a representative user interface for displaying or editing house indicia in a flashboard bingo game or related game of chance according to embodiments of the present disclosure.

FIG. 10 illustrates a representative user interface for use in flashboard bingo and related games of chance according to various embodiments of the present disclosure. User interface 1010 or a similar display may be used to display and/or edit house indicia associated with a particular game. Unser interface 1010 may include a bingo flashboard having numbers 1012 arranged in rows associated with corresponding bingo letters 1014, for example. Selected house numbers may be indicated as generally represented by 1020 using a different color or other representation. Interface 1010 may also include an area 1016 that displays the ball order or draw sequence of the selected house indicia. Various buttons, toolbars, menus, or other controls may be provided, such as reset 1022, compute 1024, and cancel 1026 depending on the particular application.

Figure 11:
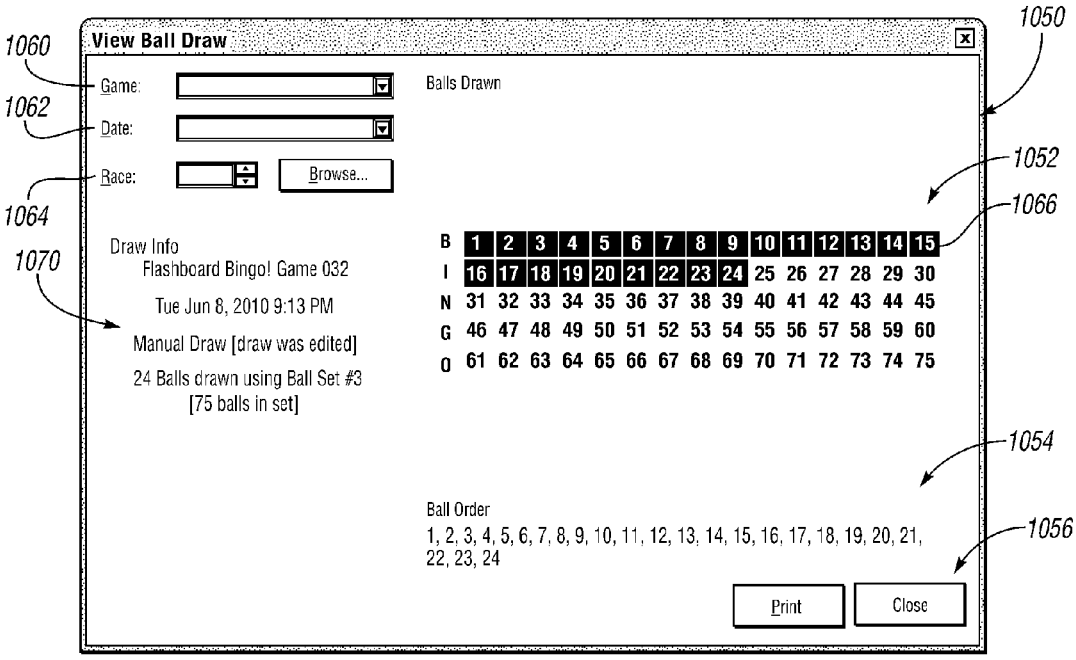
FIG. 11 illustrates a representative user interface for displaying house indicia selected in a previous flashboard bingo or related game of chance according to embodiments of the present disclosure.

FIG. 11 illustrates another representative user interface that may be used for flashboard bingo and related games of chance according to various embodiments of the present disclosure. In the example of FIG. 11, user interface 1015 may be used to view a ball draw for a selected game. User interface 1050 may include a bingo flashboard 1052 that illustrates selected house indicia as generally represented at 1066. A ball draw order or sequence area 1054 may be provided to illustrate the order that the house indicia were selected and/or displayed. Various buttons 1056 may be provided to control associated functions, such as print or close in this example. Interface 1050 may also include a pull-down menu or other device for selected or specifying a particular game as represented at 1060. Similarly, a game date may be specified as represented at 1062 and associated game or race as indicated at 1064. Additional information 1070 associated with the selected game and race may be presented from the server database. In this example, draw information is presented including the type of draw (manual), the number of draws (24), total number of available balls (75), and an identification for the balls (set #3). Of course, various other information may be presented depending on the particular application and implementation.

Figure 12:
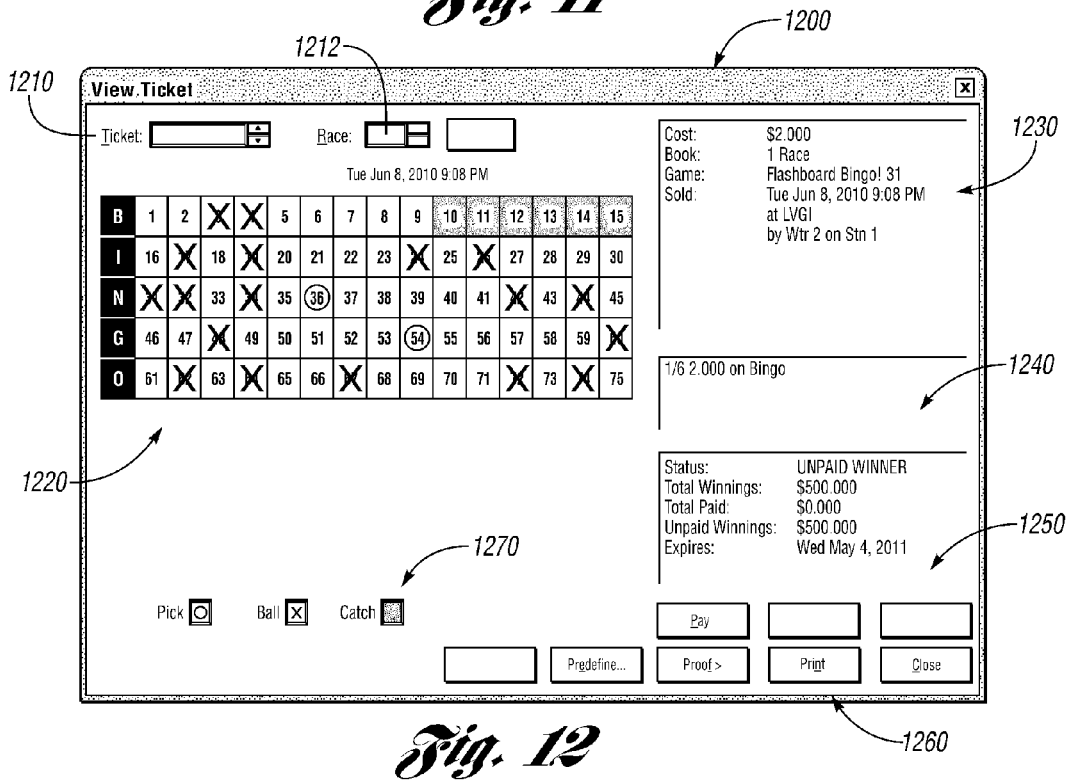
FIG. 12 illustrates a representative user interface for displaying a game ticket or card for a flashboard bingo or related game of chance according to embodiments of the present disclosure.

Another representative user interface for managing flashboard bingo or related games of chance according to the present disclosure is illustrated in FIG. 12. User interface 1200 may be used to view a selected ticket/card as indicated at 1210. For multi-game tickets, a selected game or race is indicated as represented at 1212. Interface 1200 may also include a bingo flashboard 1220 that displays the status of player and house indicia as represented by key or legend symbols 1270. In the example illustrated in FIG. 12, player indicia (pick) are represented with a circle, house indicia (ball) are represented with an "x" and matching player/house indicia (catch) are grayed out. In one embodiment, different colors are used to more easily identify pick, ball, and catch numbers displayed on flashboard 1220. As illustrated in this example, the representative ticket included 8 player picks with a house draw of 24 numbers. Six of the 8 player picks matched house numbers.

As also shown in FIG. 12, user interface 1200 may include various information display areas with information from the database(s) retrieved from the server. For example, ticket and wager information 1230, multi-ticket information 1240, and ticket status information 1250 may be displayed. Various control buttons, menus, toolbars, and the like may also be displayed to perform associated functions as generally represented by buttons 1260.

Figure 13:
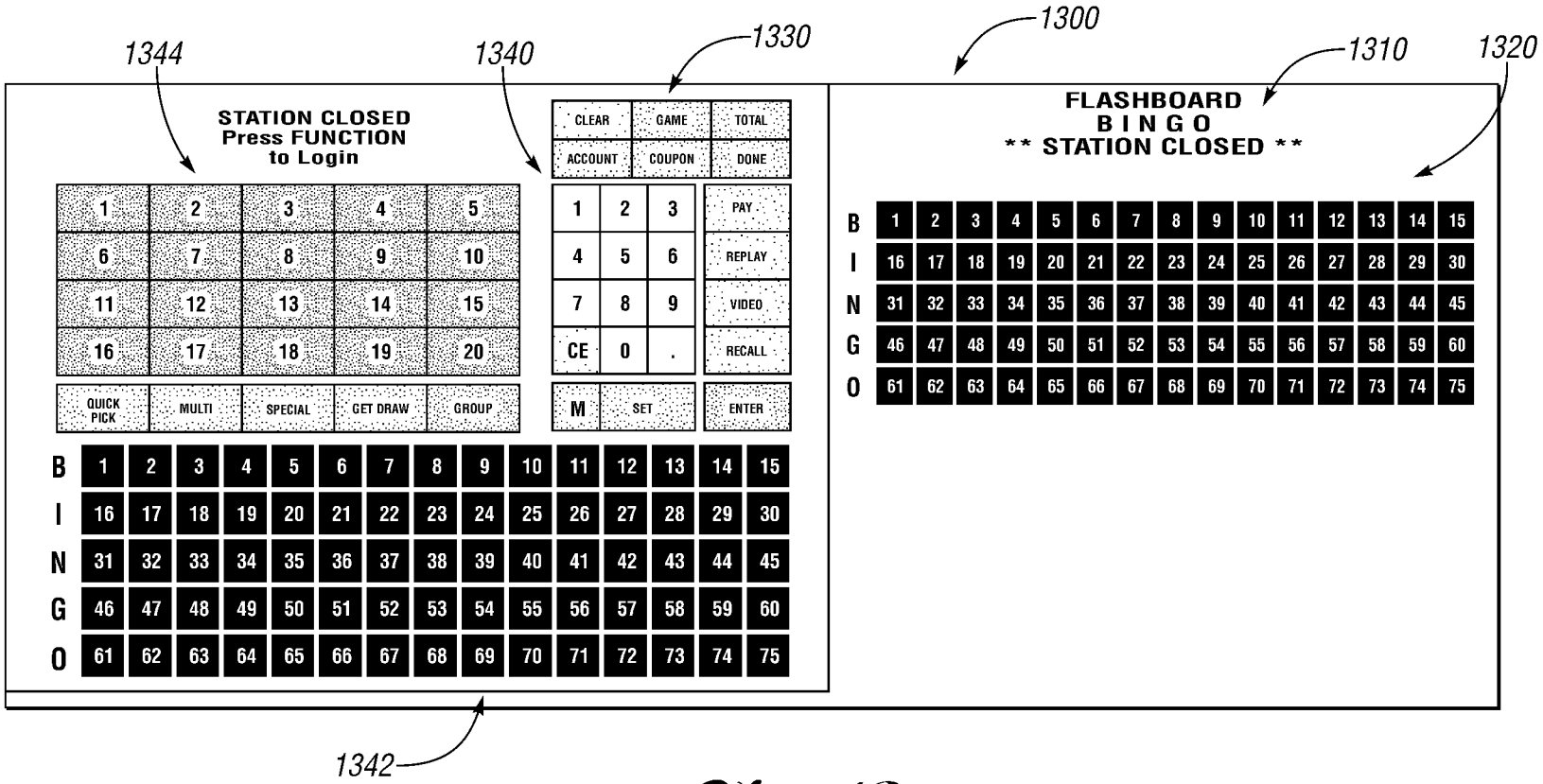
FIG. 13 illustrates a representative user interface for a ticket or card generating station for a flashboard bingo or related game of chance according to embodiments of the present disclosure.

FIG. 13 illustrates a representative user interface for a writer station or terminal in a system or method for flashboard bingo and related games of chance according to various embodiments of the present disclosure. Interface 1300 may be displayed on a touch screen display or may be operated with a mouse or other pointing device depending on the particular application and implementation. Interface 1300 may include an integrated player display that contains information currently being displayed on player stations, such as game identification and station status 1310 and a bingo flashboard 1320 illustrating selected house numbers. As previously described, player displays may include various other types of representations of house indicia, such as balls or other devices, in place of, or in addition to a bingo flashboard 1320.

User interface 1300 may also include an operator interface 1330 associated with various functions that may be performed by an operator at a ticket/card writer station. For example, operator interface 1330 may include various function buttons, a keypad and a ball draw area 1344. Selected or drawn balls or other indicia may be depicted using a bingo flashboard arrangement as generally represented at 1342.

Figure 14:
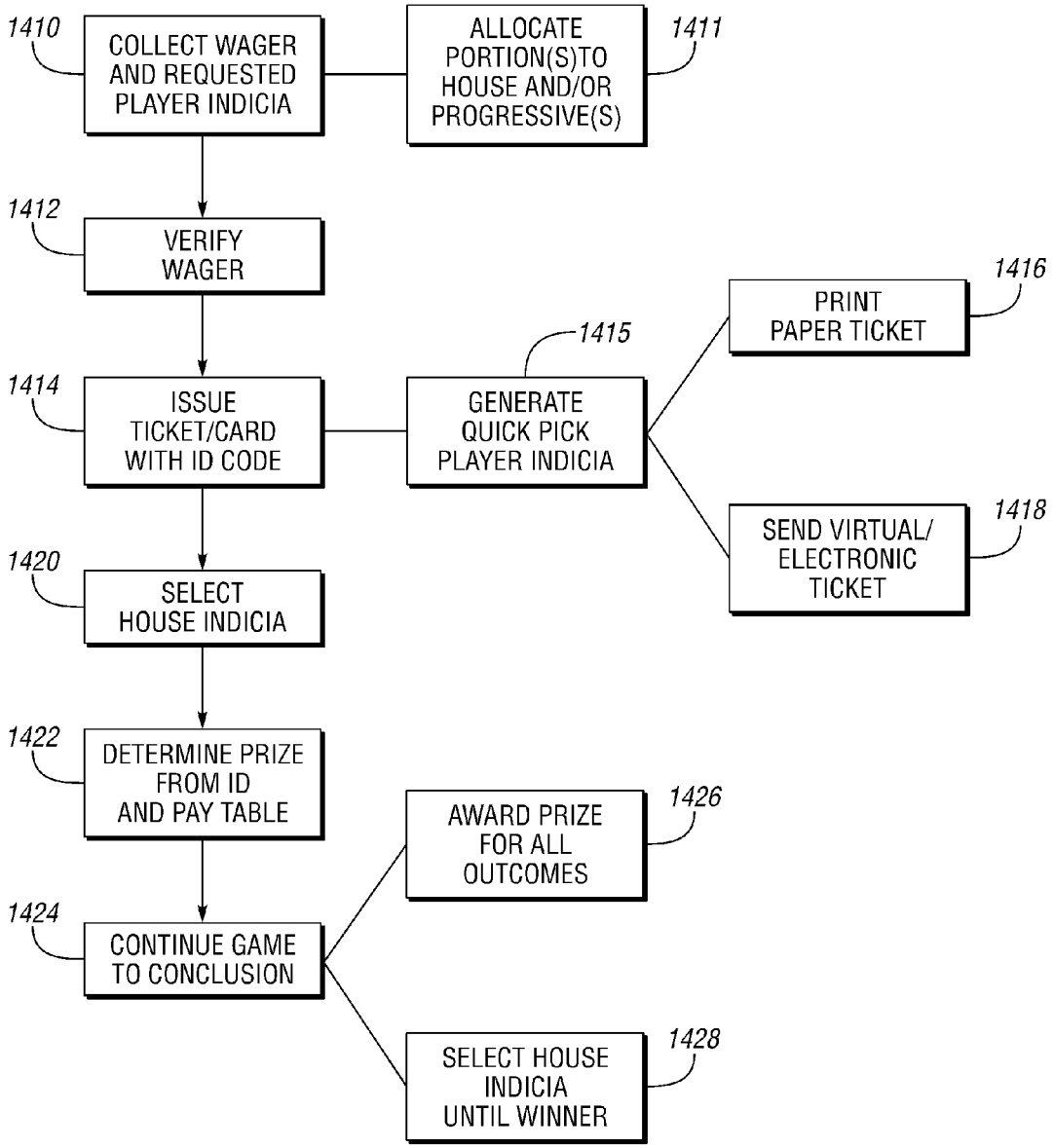
FIG. 14 is a block diagram illustrating operation of a system or method for playing flashboard bingo or a related game of chance according to embodiments of the present disclosure.

FIG. 14 provides an alternative representation illustrating operation of a system or method for playing a game of chance with tickets bearing indicia in which a player attempts to match indicia on a ticket to randomly determined house indicia to win a prize according to various embodiments of the present disclosure. The system and method may include collecting a wager and requested player indicia as represented by block 1410. The wager may be allocated based on an associated allocation table with a portion or percentage for the house and another portion allocated to a progressive prize as represented by block 1411. In some embodiments, a portion of the wager may be allocated to a seeded minimum prize for a subsequent game. The requested information may be stored in an associated pending ticket database for subsequent verification against wager limits and associated rules. After the wager and requested player indicia have been verified as represented by block 1412, the system and method may include issuing a player ticket having the players selected indicia and an identification code associated with the players selected indicia for each player ticket as represented by block 1414. Where a player has requested one or more quick pick tickets, the system and method may include randomly generating the player selected indicia in response to the player request as represented by block 1415. The corresponding ticket information may be printed on a paper ticket as represented by block 1416. Alternatively, or in combination, a virtual ticket or electronic ticket information may be communicated to an associated device having a display as represented by block 1418. Electronic ticket information may be communicated to fixed or portable player devices including handheld wireless devices, such as a cell phone.

The system and method continue with randomly selecting a first predetermined number of house indicia from a pool of available indicia as represented by block 1420. After selecting the house indicia, the system and method may include automatically determining a prize amount based on the identification code and associated player indicia relative to an associated pay table as represented by block 1422. Gameplay is continued to conclusion, i.e. until a winner is determined, as represented by block 1424. A winner may be determined by awarding a prize for all possible outcomes as represented by block 1426. Alternatively, additional house indicia may be selected until at least one winner is determined as represented by block 1428.

Figure 15:
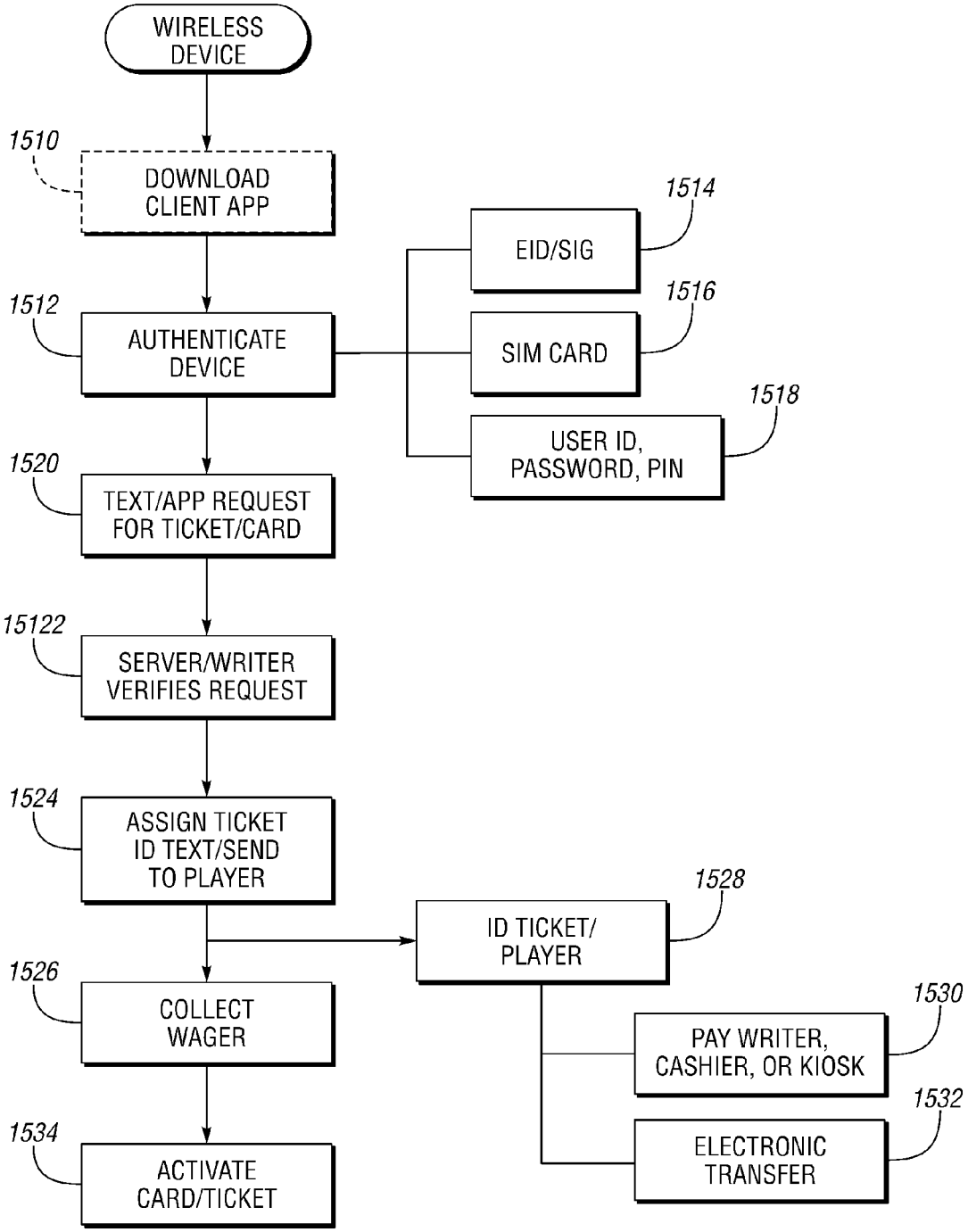
FIG. 15 is a block diagram illustrating operation of a system or method for selecting player indicia using a hand-held wireless device for flashboard bingo or a related game of chance according to embodiments of the present disclosure.

A flowchart illustrating operation of a representative system or method for requesting or selecting player indicia for flashboard bingo or a related game of chance using a wireless device according to various embodiments of the present disclosure is shown in FIG. 15. The system or method may optionally include downloading of a dedicated application for playing a particular game using a wireless device as represented by block 1510. The device may be authenticated as represented by block 1512 using an electronic identification 1514, SIM card 1516, and/or user ID and associated password or PIN 1518. The ticket/card request may be transmitted as represented by block 1520. The request may include particular player numbers or other indicia, a request for a quick pick ticket, etc. The request may be communicated securely using the previously downloaded dedicated application. Alternatively, a request for particular numbers or automatically generated numbers may be communicated using a text message as represented by block 1520.

Depending upon the particular application, a ticket request may be received by a centralized server or may be communicated to a device associated with a writer terminal or station. When communicated to a writer station, the ticket request may be manually entered by a station operator. The server then verifies the ticket request as represented by block 1522. The ticket identification number and/or symbol is assigned for valid requests as represented by block 1524. The ticket information is then sent to the player using the dedicated application, a text message, image, or other representation. The ticket identification may be designated as a pending ticket until a corresponding wager is collected as represented by block 1526. Collecting a wager may include identifying a pending ticket/player as represented by block 1528 using the associated ticket ID. The player may then pay a writer station operator, cashier, or provide appropriate payment via a kiosk as represented by block 1530. For example, a player may use a player card to debit an associated player account using a kiosk having a card reader or other input device. Alternatively, or in combination, wagers may be collected electronically with appropriate authorization as represented by block 1532. After the wager has been collected, the server activates the corresponding card/ticket as represented by block 1534.

FIG. 16 illustrates a representative ticket/card that may be used in a system or method for playing flashboard bingo and related games of chance according to various embodiments of the present disclosure. Ticket 170' may include various types of computer readable indicia 180. For example, a traditional barcode 181 may be provided in addition to a human readable identification code or serial number 183. Alternatively, or in combination, a two-dimensional barcode 185 may be provided. Computer readable indicia 180 may be used to encode various types of information associated with ticket 170'. In addition, ticket 170' includes information associated with player requested or selected indicia for a particular game as generally represented by 184' and 186'. Other game information, such as date, time, wager, etc. may also be provided as generally represented at 187. Player indicia may include a corresponding bingo letter is generally represented at 184'. Alternatively, player indicia may consist of numbers only as represented at 186'. In the representative example illustrated in FIG. 16, eight player indicia are selected for each game.

FIG. 17 illustrates a representative pay table for use in a system or method for flashboard bingo and related games of chance according to various embodiments of the present disclosure. Pay table 1700 may include a game identifier 1702. In this example, the game is a "Pick 8" game having eight player indicia. Pay table 1700 may include a column or index having a number of catches (or matches) 1710 each having an associated prize or payout 1720. In this example, some outcomes have a null or zero prize as generally indicated at 1704. As such, the game may be played to conclusion by continuing to select house indicia until at least one card/ticket matches a sufficient number of house numbers to win a prize. Pay table 1700 may include an associated house hold percentage (not shown) and probabilities or odds 1712 associated with each possible outcome 1710. Those of ordinary skill in the art will recognize that various information illustrated in FIG. 17 may be used in developing a pay table but is not required by the gaming server to determine the prize associated with a particular outcome. In general, only the outcome and associated prize is included in the gaming server database. The representative prize amounts illustrated were based on a selected house hold percentage and odds or probabilities associated with each outcome to provide a desired profit for the house and/or other entity associated with the game. Those of ordinary skill in the art will recognize that prize amounts may vary based on a number of factors that may include the odds/probability of a particular outcome, local gaming regulations, target market/demographics, desired profit, gaming expenses, etc.

FIG. 18 illustrates a pay table having a prize for all possible outcomes for use with flashboard bingo and related games of chance according to various embodiments of the present disclosure. Pay table 1800 may include a game identifier 1802 and seeded prize amount 1804. Possible outcomes (catch/match) may be indicated as represented by 1810 with associated odds indicated at 1812. Prize awards associated with each outcome 1810 are indicated at 1820. As described above with respect to FIG. 17, not all information illustrated in pay table 1800 is necessarily included in the gaming database contained within the gaming server. Similarly, various additional information may be considered in determining the prize for a particular outcome.

Although traditional bingo games and related games of chance generally have winning criterion based on forming a pattern on a player card, various embodiments of flashboard bingo and related games according to the present disclosure offer a prize for correctly matching a predetermined number of the called numbers on a playing card after a designated number of calls. For example, a grand prize or jackpot may be awarded in a "Pick 8" game for matching 8 numbers on a card after 24 calls. Similarly, different games may be played where players must match a designated number of house numbers after 24 calls with the designated number ranging between 3 and 11 in one embodiment. Of course, any designated number of matches may be used to win a particular jackpot depending on the particular player population, market, and/or other considerations. Of course, one of ordinary skill in the art will recognize that a series of pay tables may be constructed for different numbers of calls and associated prizes offered individually or collectively based on whether the game is played on a pari-mutuel basis, with progressive jackpots, with a seeded prize amount, etc. As those of ordinary skill in the art will appreciate, any game structured with payouts for all possible combinations effectively allows the operator to offer a pari-mutuel game without having any progressive meters or allocations. Pay tables may also be adjusted to allocate a portion of each wager to gaming operators and distributors, for example, depending upon the particular gaming regulations applicable in each jurisdiction. In general, various types of flashboard bingo may be characterized as attempting to match X selections to a draw of Y numbers. Corresponding pay tables may be determined based on the probability or odds of matching a particular number, and whether a prize is awarded for all possible outcomes, or only for a selected number of outcomes as previously described.

In the examples of FIGS. 17 and 18 using cards having 8 numbers, words, or other indicia with a pool of 75 available indicia and a draw of 24 indicia, the prize tables may be determined using the following calculations in combination with one or more of the previously described considerations or other considerations used to determine and/or adjust the prize amounts. One way to compute the theoretical or expected cost of offering a particular prize and constructing a corresponding pay table is to compute the probability of each event. The number of combinations of choosing K objects from a pool of N objects can be computed as follows:

$$C\left(\frac{N}{K}\right) = \frac{N!}{K!(N-K)!}$$

Where N represents the number of objects in the pool from which to choose and K represents the number of objects chosen. Once the number of combinations has been determined, the probability of a particular outcome, such as a winner or no winner, may be established by the ratio of that outcome to all possible outcomes.

Flashboard bingo and related games of chance according to various embodiments of the present disclosure may also include bonus prizes or prize awards for combinations or multiple winning games on a particular card or ticket. For example, a bonus prize or multiplier may be awarded for winning prizes in two or more consecutive games. As such, a corresponding bonus prize or prize multiplier pay table may be associated with corresponding consecutive game outcomes and stored in the gaming server to determine prize awards for winning consecutive games.

As illustrated by the previously described embodiments, systems and methods for gaming according to embodiments of the present disclosure have a number of associated advantages. For example, flashboard bingo and related gaming according to the present disclosure provides players more fun and excitement and reinvigorates operator revenues. Gaming strategies according to the present disclosure may be used to eliminate consolation prizes or to shift responsibility for consolation prizes and/or other prizes from the game operator to a third-party. Similarly, pay tables and progressive prize awards may be adjusted for particular player demographics and/or operator requirements. Various embodiments of flashboard bingo and related gaming according to the present disclosure provide a computerized ticket/card issuing and tracking system to reduce or eliminate manually matching of tickets. The computerized system may be used to manage and account for multiple progressive jackpots at a single gaming location and/or linked progressives across multiple locations. Embodiments may also include a computerized gaming system that facilitates player tracking to collect and analyze player demographics and behavior. In addition, a digital content manager may be provided to facilitate full motion video advertising on player video devices. Embodiments according to the present disclosure allow operators to generate more profit and eliminate prize exposure in favor of a fixed cost per ticket such that profits increase with increased ticket sales.

Gaming strategies according to the present disclosure may be applied to virtually any existing or future variations of bingo and similar games of chance. Various embodiments may be used with any winning pattern, combination, or number selections and the like. Cards or tickets may comprise paper, card stock, fixed, portable, or handheld electronic displays, and the like. Embodiments according to the present disclosure may be applied to fixed odds payouts, pari-mutuel, progressive, or any combination thereof. Similarly, embodiments may also be played with any approved method of determining, selecting, or calling house or game indicia such as numbers, words, or other elements to be matched including but not limited to pre-called games, random number generators, ball blowers, card draws, roulette style draws, and the like.

Various embodiments of flashboard bingo and related games may be played with at least two players each playing one or more card faces to satisfy Class II gaming requirements. The flashboard bingo and related games according to the present disclosure may also be used in various computer or machine based implementations. The flashboard bingo games according to the present disclosure provide players more excitement than traditional bingo while simplifying selection of player indicia using a familiar bingo flashboard arrangement. Various embodiments facilitate selection of player indicia using handheld mobile devices, such as cell phones and handheld computing devices via various messaging protocols, such as email, SMS (text messaging), and the like.

While one or more embodiments have been illustrated and described, it is not intended that these embodiments illustrate and describe all possible embodiments within the scope of the claims. The words used in the specification are words of description rather than limitation, and various changes may be made without departing from the spirit and scope of the disclosure. While various embodiments may have been described as providing advantages or being preferred over other embodiments or prior art implementations with respect to one or more desired characteristics, as one skilled in the art is aware, one or more features or characteristics may be compromised to achieve desired overall attributes, which depend on the specific application and implementation. These attributes include, but are not limited to: cost, strength, durability, life cycle cost, marketability, appearance, packaging, size, serviceability, weight, manufacturability, ease of assembly, distribution, etc. The embodiments described as less desirable than other embodiments or prior art implementations with respect to one or more characteristics are not outside the scope of the disclosure and may be desirable for particular applications or implementations.

What is claimed is:

1. A method of playing a game of chance, the method comprising:

providing a writer terminal, a computer server, a database, and a ticket checker including a barcode scanner;

collecting a wager using the writer terminal, the wager being applied to gameplay in the game of chance;

transmitting data representative of the wager to the computer server;

storing, by the computer server, the data representative of the wager within the database;

selecting indicia by a player using a user interface device and storing the player selected indicia, wherein each player selected indicia corresponds to a bingo letter of a bingo flashboard;

issuing a player ticket having the player selected indicia and an identification code associated with the player selected indicia for each player ticket;

storing the identification code within the database and associating the identification code with the wager;

randomly selecting a first predetermined number of house indicia from a pool of available house indicia using a house indicia generator;

scanning the identification code using the barcode scanner of the ticket checker;

transmitting the identification code to the computer server;

using the computer server to automatically determine a prize amount based on the identification code, the associated wager, and an associated pay table stored in the database, wherein the prize amount is further determined based on a number of the player selected indicia that match the randomly selected house indicia without regard to any pattern formed by the player selected indicia on the player ticket;

continuing the game of chance until at least one first player ticket wins a first prize and at least one second player ticket wins a second prize based on the associated pay table; and outputting, by a printer, a pay receipt representing the determined prize amount.

2. The method of claim 1 wherein the player selected indicia is stored in the database.

3. The method of claim 2 further comprising selecting the player selected indicia using a client device in communication with the computer server.

4. The method of claim 3 wherein the client device and the computer server are located at different gaming establishments.

5. The method of claim 1 further comprising allocating a first portion of each wager to a progressive jackpot prize.

6. The method of claim 5 further comprising allocating a second portion of each wager to the house.

7. The method of claim 1 further comprising randomly generating the player selected indicia in response to a player request for a quick pick ticket.

8. The method of claim 1 further comprising identifying the player selected indicia from a ticket request having a bingo flashboard with rows of numbers each associated with the bingo letter.

9. The method of claim 1 wherein the wager and the player selected indicia are valid for a designated number of future games of chance.

10. The method of claim 1 wherein issuing the player ticket comprises issuing an electronic representation of a player ticket.

11. The method of claim 10 wherein the electronic representation of the player ticket is wirelessly transmitted to a player designated mobile device.

12. The method of claim 1 wherein randomly selecting the house indicia comprises electronically selecting the house indicia using a random number generator.

13. The method of claim 1 further comprising displaying the randomly selected house indicia for viewing by players.

14. The method of claim 13 wherein a group of randomly selected house indicia are displayed substantially simultaneously.

15. The method of claim 1 wherein randomly selecting the house indicia comprises selecting the house indicia using a ball blower.

16. The method of claim 1 further comprising holding prizes associated with winning tickets for a predetermined period of time following a conclusion of the game of chance for claiming by a winner.

17. The method of claim 1 further comprising identifying a winning ticket based on the identification code.

18. The method of claim 17 wherein the identification code comprises a bar code.

19. The method of claim 1 further comprising communicating a ticket status to the player in response to presentation of the identification code.

20. The method of claim 19 wherein the ticket status and the identification code are communicated wirelessly to a handheld mobile device using text messages.

21. The method of claim 19 wherein the identification code is determined by a machine reader and the ticket status is displayed to the player on a device in communication with the machine reader.

22. The method of claim 1 wherein continuing the game of chance comprises concluding the game of chance after selecting the first predetermined number of house indicia, wherein the associated pay table includes a prize associated with each possible number of matching player selected indicia so that each player ticket wins a prize.

23. The method of claim 1 wherein continuing the game of chance comprises randomly selecting additional house indicia from the pool of available house indicia until each player ticket wins a prize.

24. The method of claim 1 further comprising processing a request for the player selected indicia having available numbers depicted as the bingo flashboard having five rows of fifteen numbers with each row associated with a bingo letter.

25. The method of claim 1 wherein the player selected indicia are communicated using a number selection device having available numbers depicted as the bingo flashboard.

26. The method of claim 25 wherein the number selection device comprises a wireless device.

27. The method of claim 25 wherein the number selection device comprises a mark sense scanner that communicates the player selected indicia in response to scanning a paper having the bingo flashboard and the player selected indicia marked by the player.

28. A method for playing bingo, the method comprising:

providing a writer terminal, a computer server, a database, and a ticket checker including a barcode scanner;

collecting a wager using the writer terminal and applying the wager to one or more bingo cards used in a bingo game;

transmitting data representative of the wager to the computer server;

storing, by the computer server, the data representative of the wager within the database;

selecting player numbers for each bingo card by a player using a user interface device;

storing information associated with the bingo game in the database including an identification code, the wager, and associated numbers for each bingo card used in the bingo game, and a pay table for determining prizes associated with matching a designated number of house numbers to the numbers on each bingo card;

randomly determining house numbers for the bingo game using a house number generator in communication with the computer server for communicating the randomly determined house numbers to the computer server;

presenting the randomly determined house numbers for the bingo game to game players using a device in communication with the computer server;

scanning the identification code associated with each bingo card using the barcode scanner and communicating the identification code to the computer server, wherein the computer server compares the randomly determined house numbers to the player numbers on each bingo card to determine winning cards and calculates an associated prize amount based on the pay table, the wager, and at least the number of matching player numbers and the randomly determined house numbers, and wherein the computer server continues the bingo game until at least one first bingo card wins a first prize and at least one second bingo card wins a second prize; and printing a pay receipt, using a printer, representing the calculated prize amount.

29. The method of claim 28 wherein at least some of the player numbers are selected using at least one of a deck of cards, a random number generator, a ball blower, and a ball cage.

30. The method of claim 28 wherein the device for presenting the randomly determined house numbers comprises a bingo flashboard viewable by the game players.

31. The method of claim 28 wherein presenting the randomly determined house numbers comprises communicating the randomly determined house numbers over the internet via an internet web server.

32. The method of claim 28 wherein presenting the randomly determined house numbers comprises communicating the randomly determined house numbers to a wireless handheld device.

33. The method of claim 28 wherein presenting the randomly determined house numbers comprises communicating text messages containing the randomly determined house numbers to cell phones subscribed to the bingo game.

34. The method of claim 28 wherein selecting the player numbers comprises randomly generating at least some of the player numbers for at least some of the bingo cards.

35. The method of claim 34 wherein each bingo card includes concealed numbers revealed by a pull tab.

36. The method of claim 34 wherein selecting the player numbers comprises randomly generating the player numbers in response to a player request for a quick pick card.

37. The method of claim 28 wherein selecting the player numbers comprises selecting the player numbers via a touch screen display having available numbers depicted as a bingo flashboard.

38. The method of claim 28 further comprising scanning a player request having available numbers depicted as a bingo flashboard with requested numbers marked on the bingo flashboard.

39. The method of claim 28 further comprising generating a bingo card, an associated identification code, and requested numbers in response to a cell phone text message containing requested player numbers.

40. The method of claim 39 further comprising communicating the associated identification code to the cell phone using the computer server.

41. The method of claim 39 wherein the bingo card comprises a virtual bingo card.

42. The method of claim 38 further comprising:

concluding the bingo game after the designated number of the randomly determined house numbers have been determined, wherein the pay table includes a prize associated with every number of matches from zero to the designated number of house numbers.

43. The method of claim 42 further comprising determining at least some of the house numbers before any wagers are accepted.

44. The method of claim 28 further comprising printing a bingo card having an associated identification code.

45. The method of claim 44 wherein the identification code comprises a bar code.

46. The method of claim 28 wherein scanning the identification code comprises scanning a bar code representation of the identification code.

47. The method of claim 28 further comprising displaying at least one of a bingo card status and prize information on a display screen in response to scanning the identification code.

* * * * *